US008280069B2

(12) United States Patent
Maeda et al.

(10) Patent No.: US 8,280,069 B2
(45) Date of Patent: Oct. 2, 2012

(54) NOISE REDUCTION APPARATUS

(75) Inventors: Tsuyoshi Maeda, Hyogo (JP); Yoshifumi Asao, Osaka (JP); Hiroyuki Kano, Hyogo (JP)

(73) Assignee: Panasonic Corporation, Osaka (JP)

( * ) Notice: Subject to any disclaimer, the term of this patent is extended or adjusted under 35 U.S.C. 154(b) by 293 days.

(21) Appl. No.: 12/705,743

(22) Filed: Feb. 15, 2010

(65) Prior Publication Data

US 2010/0208911 A1 Aug. 19, 2010

(30) Foreign Application Priority Data

Feb. 16, 2009 (JP) ..... 2009-032180

(51) Int. Cl.
*H04R 3/02* (2006.01)

(52) U.S. Cl. ..... 381/73.1; 381/71.1; 381/71.11; 381/71.4; 381/71.2; 381/94.1; 704/226; 704/227; 704/228

(58) Field of Classification Search ..... 381/73.1, 381/71.11, 71.1, 71.4, 71.2, 71.12, 94.1, 381/56–59, 94.7; 704/226–228, 233; 379/392.01
See application file for complete search history.

(56) References Cited

U.S. PATENT DOCUMENTS

| | | | | |
|---|---|---|---|---|
| 3,762,766 | A * | 10/1973 | Barecki et al. | 297/217.1 |
| 5,563,954 | A * | 10/1996 | Ono et al. | 381/94.7 |
| 5,987,144 | A * | 11/1999 | Carme et al. | 381/72 |
| 6,343,127 | B1 * | 1/2002 | Billoud | 381/71.4 |
| 6,418,227 | B1 * | 7/2002 | Kuo | 381/71.11 |
| 6,450,289 | B1 * | 9/2002 | Field et al. | 181/224 |
| 6,768,800 | B2 * | 7/2004 | Enamito et al. | 381/71.5 |
| 7,352,870 | B2 * | 4/2008 | Enamito et al. | 381/71.2 |
| 7,975,158 | B2 * | 7/2011 | Elgousi et al. | 713/330 |
| 2001/0046303 | A1 * | 11/2001 | Ohnishi et al. | 381/71.7 |
| 2002/0076059 | A1 * | 6/2002 | Joynes | 381/71.6 |
| 2005/0175187 | A1 * | 8/2005 | Wright et al. | 381/71.12 |
| 2007/0047743 | A1 * | 3/2007 | Taenzer et al. | 381/92 |
| 2007/0223714 | A1 * | 9/2007 | Nishikawa | 381/71.1 |

FOREIGN PATENT DOCUMENTS

| | | | |
|---|---|---|---|
| JP | 05-281980 | A * | 10/1933 |
| JP | 04359297 | A * | 12/1992 |
| JP | 07-160280 | A | 6/1995 |
| JP | 07160280 | A * | 6/1995 |
| JP | 10-171468 | A | 6/1998 |

OTHER PUBLICATIONS

Anderson et al; Study of Causal Component Placement in an Active Sound Cancellation System, 2006.*

Sven Johansson, Active Control of Propeller-Induced Noise in Aircraft, 2000.*

Eileen Anderson, Characterization of Active Sound Cancellation Zone of Silence in Reverberant Enclosure with Periodic Disturbance, 2004.*

* cited by examiner

*Primary Examiner* — Davetta W Goins
*Assistant Examiner* — Kuassi Ganmavo
(74) *Attorney, Agent, or Firm* — Pearne & Gordon LLP

(57) ABSTRACT

In a noise reduction apparatus for controlling noise up to a predetermined upper limited frequency, a distance from a noise source to control point X is made larger than a distance obtained by subtracting a one-half wavelength from a distance, obtained by adding up a distance from the noise source to a noise detecting microphone, a distance corresponding to time as a sum of respective delay time of the noise detecting microphone, a noise controller, and a control speaker, and a distance from the control speaker to control point X, where one wavelength is a period corresponding to the upper limited frequency.

7 Claims, 26 Drawing Sheets

$Tq=\tau 2+\tau 3+\tau 4+\tau 5$

FIG. 30

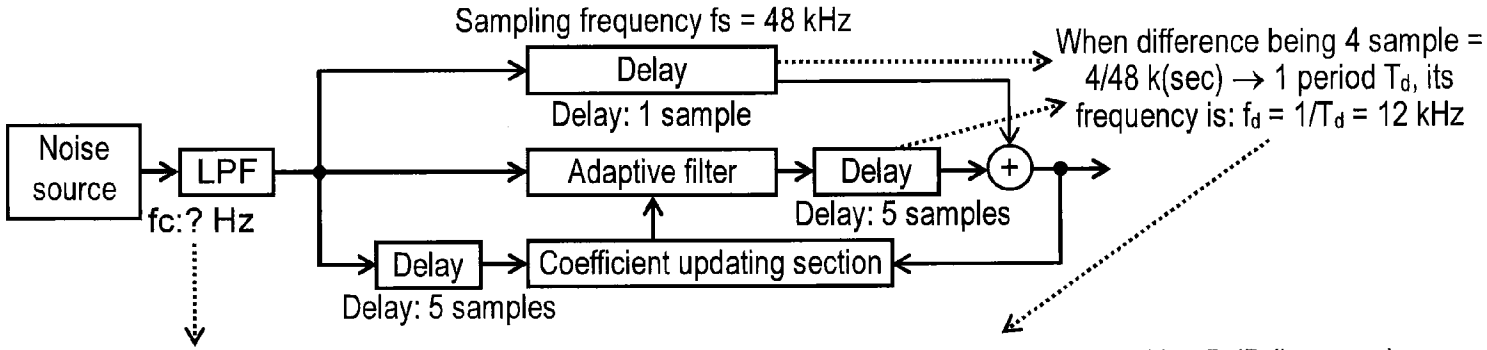

- fc = 12 kHz (= fd) → when this is set as 1 wavelength, wavelength of fd is λ; amount of noise reduced is –5 dB (increase)
- fc = 6 kHz (= fd/2) → when this is set as 1 wavelength, wavelength of fd is λ/2; amount of noise reduced is 0 dB
- fc = 4 kHz (= fd/3) → when this is set as 1 wavelength, wavelength of fd is λ/3; amount of noise reduced is 5 dB
- fc = 3 kHz (= fd/4) → when this is set as 1 wavelength, wavelength of fd is λ/4; amount of noise reduced is 10 dB decrease
- fc = 2 kHz (= fd/6) → when this is set as 1 wavelength, wavelength of fd is λ/6; amount of noise reduced is 12 dB decrease
- fc = 1.5 kHz (= fd/8) → when this is set as 1 wavelength, wavelength of fd is λ/8; amount of noise reduced is 15 dB decrease
- fc = 1 kHz (= fd/12) → when this is set as 1 wavelength, wavelength of fd is λ/12; amount of noise reduced is 18 dB decrease
- fc = 750 Hz (= fd/16) → when this is set as 1 wavelength, wavelength of fd is λ/16; amount of noise reduced is 20 dB decrease

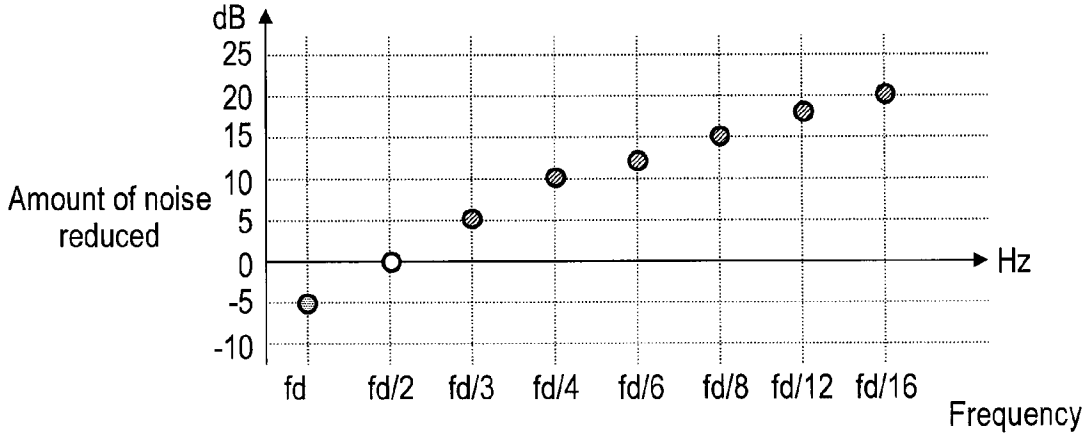

NOISE REDUCTION APPARATUS

BACKGROUND OF THE INVENTION

1. Field of the Invention

The present invention relates to a noise reduction apparatus, and particularly to a noise reduction apparatus for use inside a hermetically sealed structure such as an aircraft or a railroad vehicle.

2. Description of the Related Art

In a case of providing a user seated on a seat with information such as voice service in, for example, an aircraft or a vehicle with high noise, noise present in the seat is a problem to deal with.

An inner space with its boundary made by a continuous wall, such as the aircraft and the vehicle, is a sort of hermetically sealed structure, and when a noise source is present inside or outside the space, an environment noisy to the user is fixed. Therefore, depending on degree of noise, noise may become a factor of putting physical or mental pressure on the user, thereby reducing amenity. Especially, in a case of providing a passenger with service as a cabin of an aircraft or the like, the quality of service operations may be seriously hindered.

Particularly, in the case of the aircraft, noise of equipment for generating thrust of the aircraft which are chiefly propellers and engines, and a sound associated with an air current generated with movement of an airframe in airspace, such as a wind noise sound during flight, are principal noise sources, and in-flight noise interferes with voice service and the like as well as making the passenger uncomfortable, whereby there has been a strong demand for improvement.

In response to this, as a measure to reduce noise inside a hermetically sealed room, a method by means of passive attenuation means has hitherto been in general use, in which a sound insulating material having acoustic absorbency, such as a barrier material or an absorption material is arranged between the hermetically sealed structure and a noise emitting source. A high-density barrier material or the like is used as the barrier material, and a sound absorbing sheet or the like is used as the absorption material. The material having acoustic absorbency typically has high density, and a high-density material involves an increase in weight. With increase in weight, a fuel for flight increases, to decrease a flying range. This thus leads to deterioration in cost efficiency and functionality as the aircraft. Further, deterioration in functionality as a structural material in terms of strength such as fragility and design such as a texture cannot be ignored.

As opposed to the measure against noise by means of the passive attenuation means, a method for generating a sound wave with an opposite phase to a phase of noise has been in practice as a method for reducing noise by active attenuation means. This method can reduce a noise level at the noise emitting source or in the vicinity thereof, so as to prevent propagation of noise to an area where noise is required to be reduced.

Further, as examples of handling arrangement of structural components or delay time that involves noise reduction in the noise reduction apparatus, there have been proposed the following methods to be performed in a silencer intended for electrical equipment such as an air conditioner: a method of considering installation positions of a microphone and a speaker, propagation time for noise, and delay time concerning a control sound emitted from the speaker, to enhance a silencing effect of a low-frequency component of the noise (e.g. see Unexamined Japanese Patent Publication No. H07-160280); and a method of considering an installation position of a speaker with respect to a place where noise is to be reduced (hereinafter also referred to as "silencing center" or a "control point"), to enhance the silencing effect on random noise (e.g. see Unexamined Japanese Patent Publication No. H10-171468).

In the active noise reduction apparatus, it is common to adopt feed forward control (hereinafter abbreviated as "FF control") from the viewpoint of stability of the control. In the FF control, noise from the noise source is detected with the microphone, and for generating a control sound with an opposite phase to that of the detected noise signal to cancel noise, it is of necessity to reliably generate the control sound within the time until arrival of the noise at the silencing center (time causality limitation). However, in a case where a large number of noise sources are present as inside the cabin of the aircraft, arranging the microphone as close to the speaker and the silencing center as possible can effectively reduce noise since the correlation between noise at the silencing center and noise collected with the microphone is high, but in such a manner, there may be cases where the time causality limitation cannot be satisfied. There has thus been a desire for a method capable of reducing noise even in the case of not being able to satisfy the time causality limitation.

As for the arrangement of the structural components and the delay time that involves noise reduction in the noise reduction apparatus, the silencer proposed in Unexamined Japanese Patent Publication No. H07-160280 only performs adjustment of delay time concerning silencing based on a difference between propagation time for a sound from the microphone to the silencing center and propagation time for a sound from the speaker to the silencing center, and the silencer is strictly subject to satisfaction of the time causality limitation.

Further, in Unexamined Japanese Patent Publication No. H10-171468, among the structural components in the noise reduction apparatus, the speaker including a large delay factor is arranged on the silencing center side rather than the noise source for the purpose of compensating high-frequency phase characteristics, and also, ideal phase characteristics of a gain and a phase becoming constant with respect to a frequency is considered. However, this case is also subject to satisfaction of the time causality limitation. As thus described, the conventional methods are subject to satisfaction of the time causality limitation, and do not disclose any method for effectively performing noise reduction in an environment where the time causality limitation cannot be satisfied, such as inside the cabin of the aircraft.

CITATION LIST

Patent Literature

Patent Literature 1: Unexamined Japanese Patent Publication No. H07-160280

Patent Literature 2: Unexamined Japanese Patent Publication No. H10-171468

SUMMARY OF THE INVENTION

A noise reduction apparatus of the present invention is one provided with: a noise detecting microphone that detects noise emitted from a noise source; a control speaker that emits a control sound for canceling the noise at a control point in a control space based on a control sound signal; and a noise controller that generates the control sound signal, wherein when control sound delay time, obtained by adding control delay time as a sum of respective delay time of the noise detecting microphone, the noise controller, and the control speaker to control sound transmittance time taken by a control sound to transmit from the control speaker to the control point, is larger than noise transmittance time taken by noise to transmit from the noise detecting microphone to the control point, the noise controller generates the control sound signal with one-half of a frequency, one period of which is a difference between the control sound delay time and the noise transmittance time, as an upper limited frequency.

Accordingly, even in an environment where time causality limitation cannot be satisfied in the positional relation among the noise detecting microphone, the control speaker, and the control point (silencing center) in a passenger seat of a vehicle or the like, limiting a control band can effectively exert a noise reduction effect.

BRIEF DESCRIPTION OF DRAWINGS

FIG. 30 shows a diagram illustrating a result of plotting, from FIGS. 22 to 29, amounts of noise reduced in the noise reduction apparatus in the embodiment of the present invention;

DETAILED DESCRIPTION OF THE PREFERRED EMBODIMENT

Hereinafter, an embodiment of the present invention is described with reference to FIGS. 1 to 7.

Embodiment

A noise reduction apparatus in the embodiment of the present invention is described below citing examples of cases where the apparatus is mounted in an aircraft.

First, a sound environment in the aircraft that requires installation of the noise reduction apparatus is described with reference to FIGS. 1 and 2.

Figure 1:
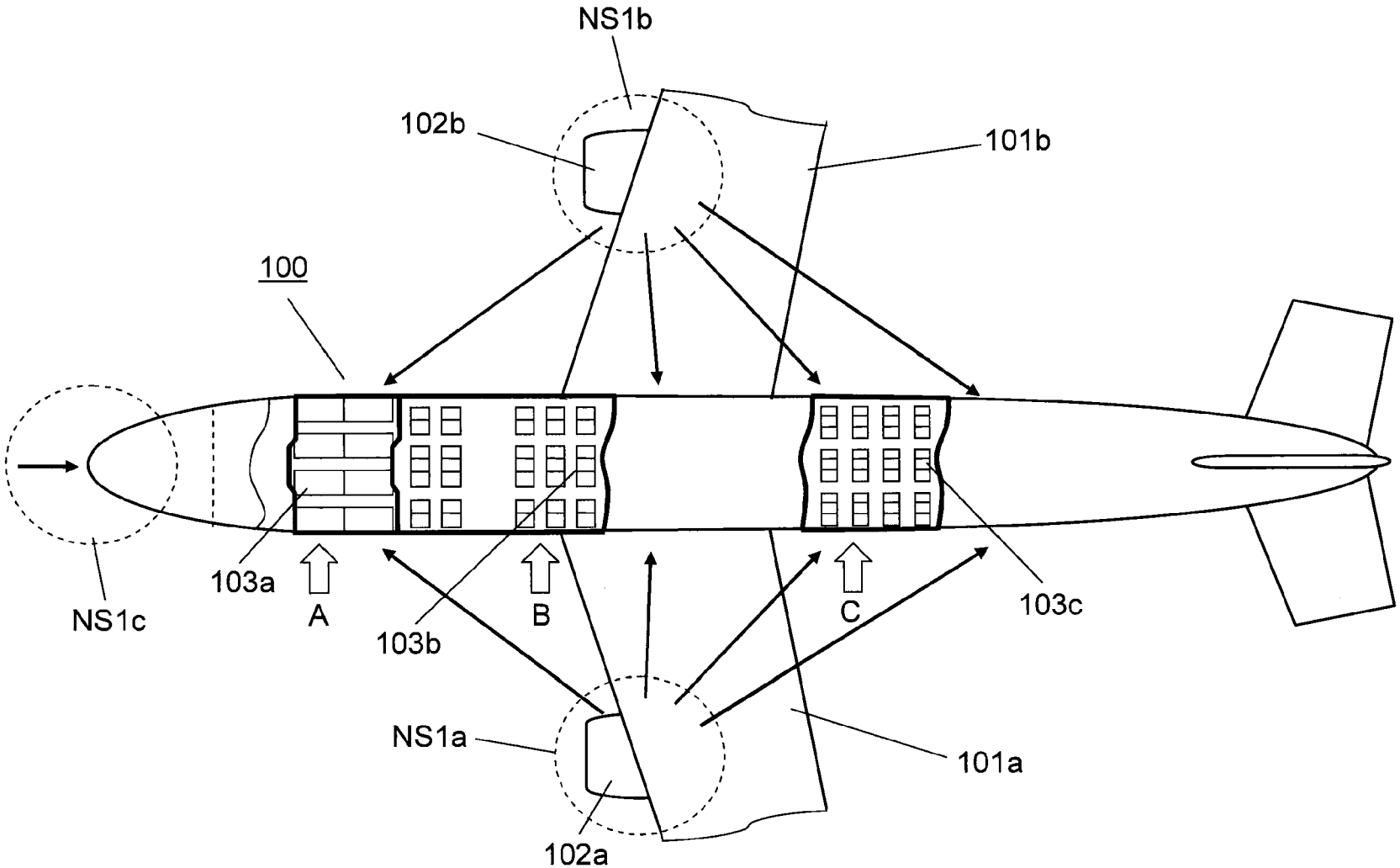
FIG. 1 shows a plan view illustrating an installation environment of a noise reduction apparatus in an embodiment of the present invention.

FIG. 1 is a plan view illustrating an installation environment of the noise reduction apparatus in the embodiment of the present invention. As illustrated in FIG. 1, aircraft 100 is provided with left and right wings 101*a*, 101*b* and engines 102*a*, 102*b* mounted on the wings.

From the viewpoint of the sound environment of the aircraft, the engine takes an important position as a noise source not only because of its birl, but also because it involves reverberation of an air current and the like during flight. From the viewpoint of user service, engines 102*a*, 102*b* act on each section of an airframe as external noise sources NS1*a*, NS1*b* with respect to, seat rows (103*a*, 103*b*, 103*c*) provided in, for example, cabin A (e.g. first class), cabin B (e.g. business class), and cabin C (e.g. economy class) in the aircraft, and besides, sounds of collision with air currents (wind noise sounds) at a tip of the airframe, front edges of left and right wings 101*a*, 101*b*, and the like, which are generated with movement of the airframe in the airspace at high speed, have adverse effects on in-flight information provision service and the like as the noise source. FIG. 1 shows a collision sound at the tip of the airframe as noise source NS1*c*, typifying the collision sound with the air current.

Figure 2:
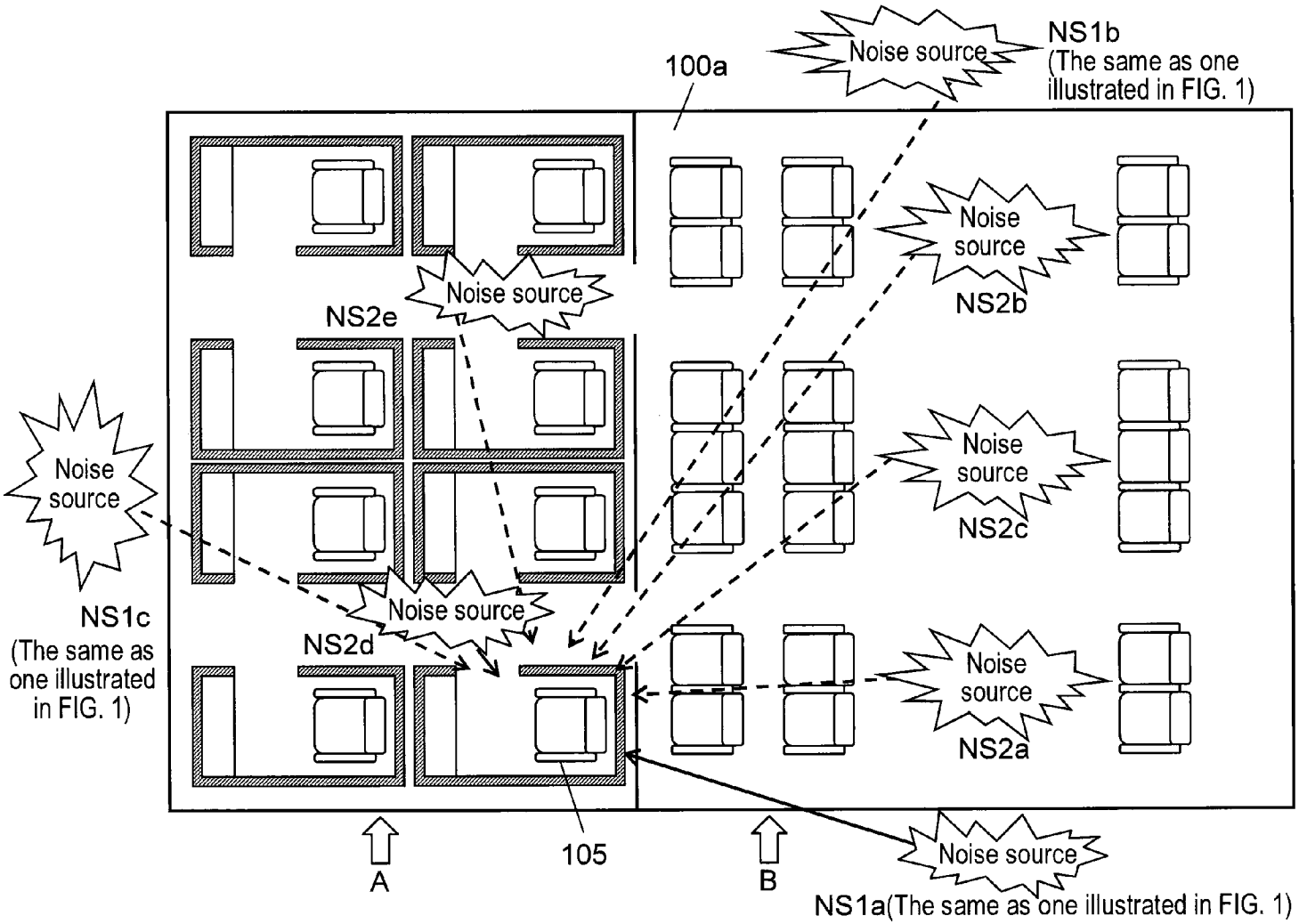
FIG. 2 shows a plan view illustrating a detail of the installation environment of the noise reduction apparatus in the embodiment of the present invention.

FIG. 2 is a plan view illustrating a detail of an installation environment of the noise reduction apparatus, in which arrangement of seats in parts of cabin A and cabin B in FIG. 1 are shown as enlarged. Cabin 100*a* is partitioned with walls into cabin A and cabin B, and respective seat rows are provided in cabin A and cabin B. Meanwhile, as for a sound environment of cabin 100*a*, in addition to the presence of noise source NS1*a*, NS1*b* generated from engines 102*a*, 102*b* and wind noise source NS1*c* at the tip of the airframe as the external noise sources, noise sources NS2*a* to NS2*e* caused by an air conditioner and the like are present as internal noise sources. Considering these as noises present in one seat 105 arrayed in cabin A, seat 105 is affected by noises from engines 102*a*, 102*b* (FIG. 1) mounted on the wings outside windows, noise sources NS1*a* to NS1*c* whose noise generation causes are air current sounds, and noise sources NS2*a* to NS2*e* whose noise generation causes are the air conditioner.

In particular, in the first class shown as cabin A in FIG. 1, and the like, the seat has a shell structure, provided with audiovisual equipment, such as a television and a radio, for enjoying a movie and music, a desk for a business person, a PC connection power supply, and the like, and is strongly required to provide a user with an environment allowing the user to feel relaxed or concentrate on work. There has thus been particularly a high desire for reduction in noise inside this shell.

Next, a basic configuration of the noise reduction apparatus in the embodiment of the present invention is described with reference to FIGS. 3A, 3B.

Figure 3B:
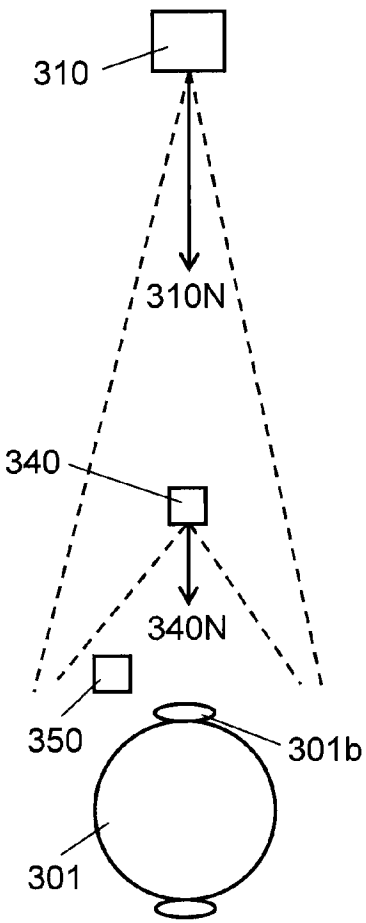
FIG. 3B shows a diagram for explaining a method to superimpose a control sound emitted from a control speaker and noise emitting from a noise source on each other in the noise reduction apparatus in the embodiment of the present embodiment.
Figure 3A:
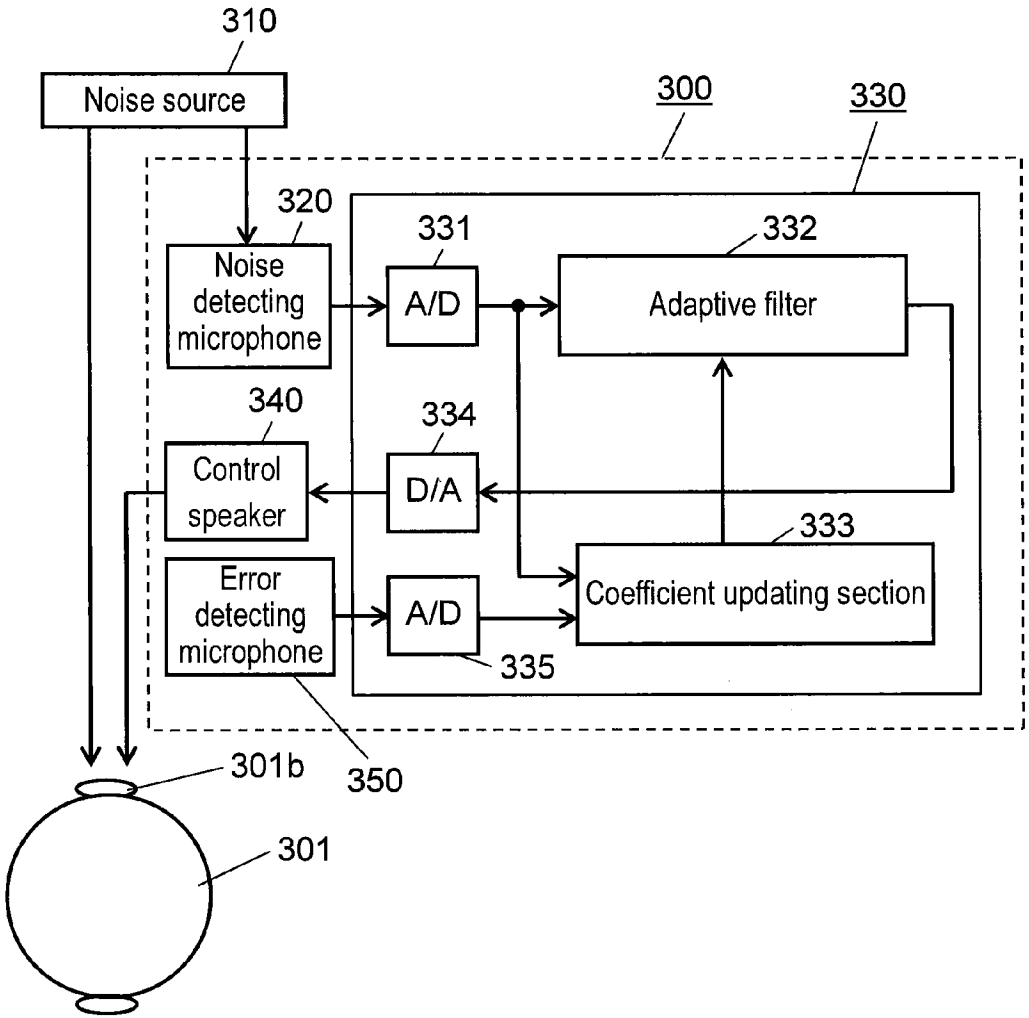
FIG. 3A shows a block diagram illustrating a basic configuration of the noise reduction apparatus in the embodiment of the present invention.

FIG. 3A is a block diagram illustrating a basic configuration of the noise reduction apparatus in the embodiment of the present invention. The FF control is used in the noise reduction apparatus of the present embodiment.

Noise reduction apparatus 300 is provided with noise detecting microphone 320, noise controller 330, control speaker 340, and error detecting microphone 350. Respective configurations and functions thereof are described below.

Noise detecting microphone 320 detects noise emitted from noise source 310, converts the noise into an electronic signal, and outputs the signal.

Noise controller 330 is provided with A/D converters 331, 335, adaptive filter 332, coefficient updating section 333, and D/A converter 334, and generates a control sound signal to control control speaker 340, so as to minimize a detected error based on the noise signal from noise detecting microphone 320 and an error signal from error detecting microphone 350.

A/D converter 331 A/D converts the noise signal from noise detecting microphone 320, and outputs the converted signal to adaptive filter 332 and coefficient updating section 333. Adaptive filter 332 is an FIR filter configured of multi-stage taps and is capable of freely setting a filter coefficient for each tap. Coefficient updating section 333 receives an input of the detected-error signal from error detecting microphone 350 through A/D converter 335, in addition to the signal from noise detecting microphone 320, and adjusts each of the filter coefficients of adaptive filter 332 mentioned above, so as to minimize the detected error. In other words, in the installation position of error detecting microphone 350, a control sound signal is generated so as to have an opposite phase to that of the noise from noise source 310, and outputs the generated signal to control speaker 340 through D/A converter 334. Control speaker 340 is capable of converting the control sound signal received from D/A converter 334 into a sound wave and outputting the sound wave, and is provided with a function of emitting a control sound to cancel noise in the vicinity (control point) of ear 301*b* of user 301.

Error detecting microphone 350 detects a sound after noise reduction as an error, and performs feedback on an operating result for noise reduction apparatus 300. This can constantly minimize noise in the position of the ear of the user even with a change in noise environment or the like.

As illustrated in FIG. 3A, in noise reduction apparatus 300 in the embodiment of the present invention, noise emitted from noise source 310 is detected by noise detecting microphone 320 and subjected to signal processing in noise controller 330, to generate a control sound from control speaker 340, and the noise emitted from noise source 310 and the sound with its phase reversed to that of the noise are superimposed on each other and emitted to ear 301*b* of user 301, thereby to reduce the noise.

FIG. 3B shows a method for superimposing a control sound emitted from control speaker 340 and noise emitting from noise source 310 on each other.

Control speaker 340 is arranged inside main arrival channel 310N for noise which connects noise source 310 and ear 301*b* of user 301. Herewith, a control sound with a reversed phase that is generated from control speaker 340 is superimposed with the noise, which arrives at ear 301*b* of user 301. Further, error detecting microphone 350 is arranged inside a superimposition area, thereby to detect a sound after noise reduction as an error and perform feedback on the operating result for noise reduction apparatus 300, so that the noise reduction effect can be enhanced.

Next, structural characteristics in the case of installing the noise reduction apparatus (hereinafter abbreviated as "present apparatus") in the embodiment of the present invention in a cabin of an aircraft are described with reference to FIGS. 4A to 4D.

FIGS. 4A to 4D are plan views each illustrating a principal configuration of four installation examples of the noise reduction apparatus installed in the cabin of the aircraft in the embodiment of the present invention.

Figure 4A:
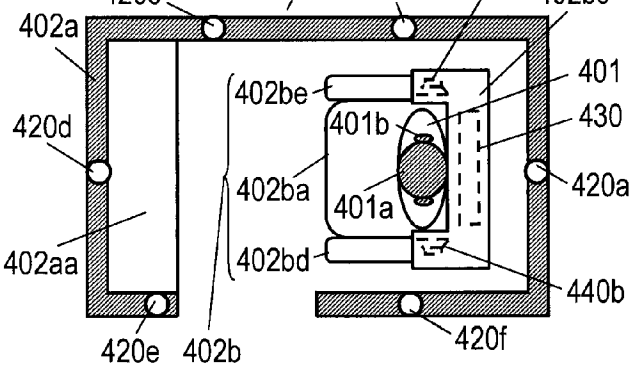
FIG. 4A shows a principal plan view illustrating a configuration of an installation example of the noise reduction apparatus in the embodiment of the present invention, as well as a view illustrating an example of arranging a noise detecting microphone on a top of a wall surface of a shell section.
Figure 4B:
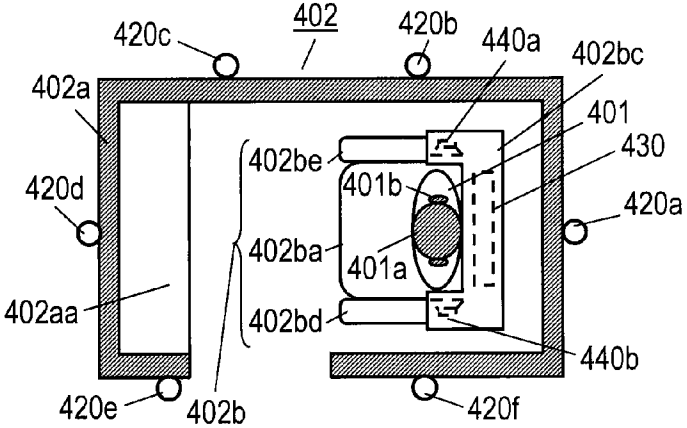
FIG. 4B shows a principal plan view illustrating a configuration of an installation example of the noise reduction apparatus in the embodiment of the present invention, as well as a view illustrating an example of arranging the noise detecting microphone on an outer wall surface of a shell section.
Figure 4C:
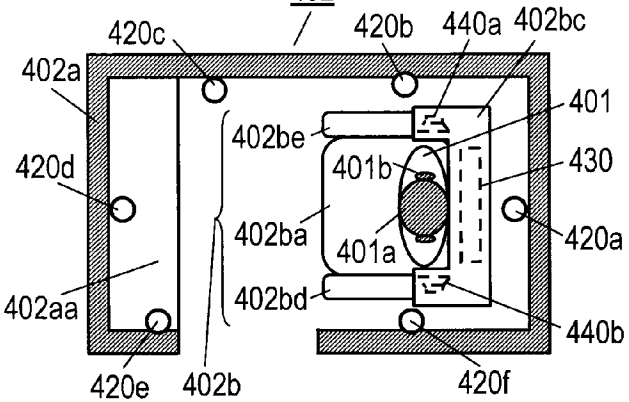
FIG. 4C shows a principal plan view illustrating a configuration of an installation example of the noise reduction apparatus in the embodiment of the present invention, as well as a view illustrating an example of arranging the noise detecting microphone on an inner wall surface of a shell section.
Figure 4D:
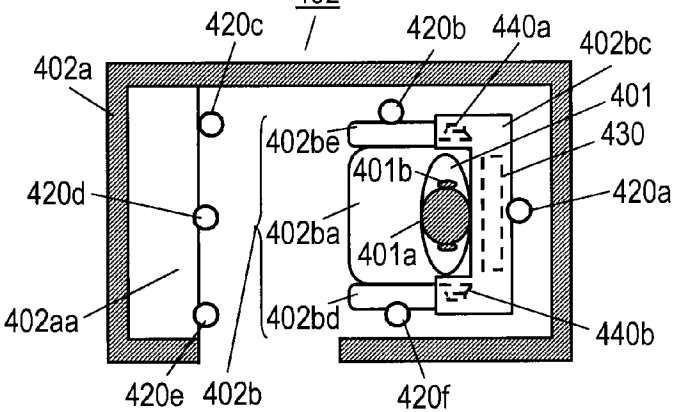
FIG. 4D shows a principal plan view illustrating a configuration of an installation example of the noise reduction apparatus in the embodiment of the present invention, as well as a view illustrating an example of arranging the noise detecting microphone inside a shell section.

FIGS. 4A to 4D are different in arrangement relation among noise detecting microphones 420*a* to 420*f*, control speakers 440*a*, 440*b*, and shell section 402*a* as a soundproof wall: FIG. 4A shows an example of arranging noise detecting microphones 420*a* to 420*f* at a top of a wall surface of shell section 402*a*; FIG. 4B shows an example of arranging noise detecting microphones 420*a* to 420*f* on an outer wall surface of shell section 402*a*; FIG. 4C shows an example of arranging noise detecting microphones 420*a* to 420*f* on an inner wall surface of shell section 402*a*; and FIG. 4D shows an example of arranging noise detecting microphones 420*a* to 420*f* inside shell section 402*a*. Using shell section 402*a* as the soundproof wall, the noise reduction apparatus can absorb a high-frequency component of noise from the noise source in shell section 402*a*, to prevent entry of the component inside shell section 402*a*.

The configuration of the present apparatus is described based on the example of FIG. 4A. As illustrated in FIG. 4A, the present apparatus is installed in seat 402 as a control space that is arrayed in cabin A (FIG. 1) of the aircraft and controls noise.

Seat 402 is provided with: shell section 402*a* that surrounds the periphery with a wall surface in shell shape to provide an occupied area for the user; and seat section 402*b* arranged inside shell section 402*a*. Shell section 402*a* is provided with shelf section 420*aa* in a position opposed to the front of seat section 402*b* and is capable of exerting a function as a desk. Further, seat section 402*b* is provided with a backrest section (not illustrated), headrest 402*bc*, and armrest sections 402*bd*, 402*be*.

As for a sound environment in cabin A of the aircraft, the noise sources such as the engines mounted on the airframe, the air conditioner installed inside the cabin, and others are present, and noise emitted from the noise source arrives at an outer peripheral section of shell section 402*a* in seat 402. With respect to these, for example, six noise detecting microphones (hereinafter simply referred to as "microphones") 420*a* to 420*f* are installed at the top of the wall surface of shell section 402*a* in seat 402.

Further, headrest 402*bc* has a C-shape, and when user 401 is seated on seat 402, head 401*a* comes into a state of being surrounded by headrest 402*bc*. Moreover, noise controller 430 and control speakers (hereinafter simply referred to as "speakers") 440*a*, 440*b* are embedded in headrest 402*bc*, and speakers 440*a*, 440*b* are arranged as opposed to ears 401*b* with respect to head 401*a* of user 401.

Since the three other examples are also different only in arrangement of microphones 420*a* to 420*f* and the same in the other configurations, descriptions of these configurations are omitted. Characteristics of the respective examples are as follows.

First, when microphones 420*a* to 420*f* are installed at the top of the wall surface of shell section 402*a* as illustrated in FIG. 4A, in the case of shell section 402*a* having a high soundproofing effect, noise entering over shell section 402*a* can be efficiently detected.

Further, when microphones 420*a* to 420*f* are arranged on the outer wall surface of shell section 402*a* as illustrated in FIG. 4B, noise coming through a relatively low channel can be efficiently detected, while a high-frequency component such as a voice spoken by user 401 in shell section 402*a* can be made difficult to pick up as noise, thereby to prevent a problem of a noise increase due to feedback on a voice.

Moreover, when microphones 420*a* to 420*f* are arranged on the inner wall surface of shell section 402*a* as illustrated in FIG. 4C, since the blocking properties of shell section 402*a* deteriorate with a lower frequency, noise having transmitted through shell section 402*a* as low-frequency noise can also be reliably detected.

Finally, when microphones 420*a* to 420*f* are arranged inside shell section 402*a* as illustrated in FIG. 4D, noise can be detected in the vicinity of ear 401*b* of user 401 where noise should be reduced, and hence this is particularly effective in a case where a large number of noise sources are present and identifying a principal noise source is difficult. Further, with the noise microphone being close to the control point, the correlation between a noise signal detected with the noise microphone and noise at the control point improves, resulting in improvement in noise reduction effect.

Figure 5B:
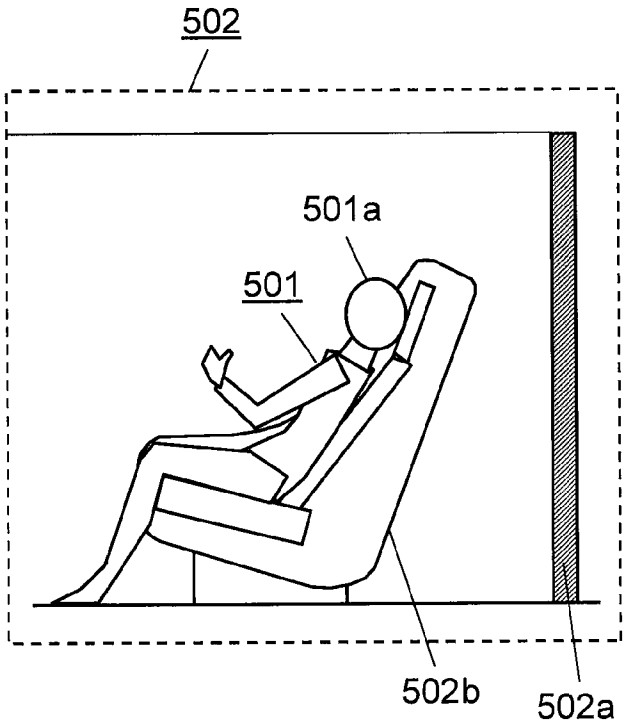
FIG. 5B shows a side view schematically illustrating the arrangement example of the principal structural components of the seat which are installed in the noise reduction apparatus in the embodiment of the present invention.
Figure 5A:
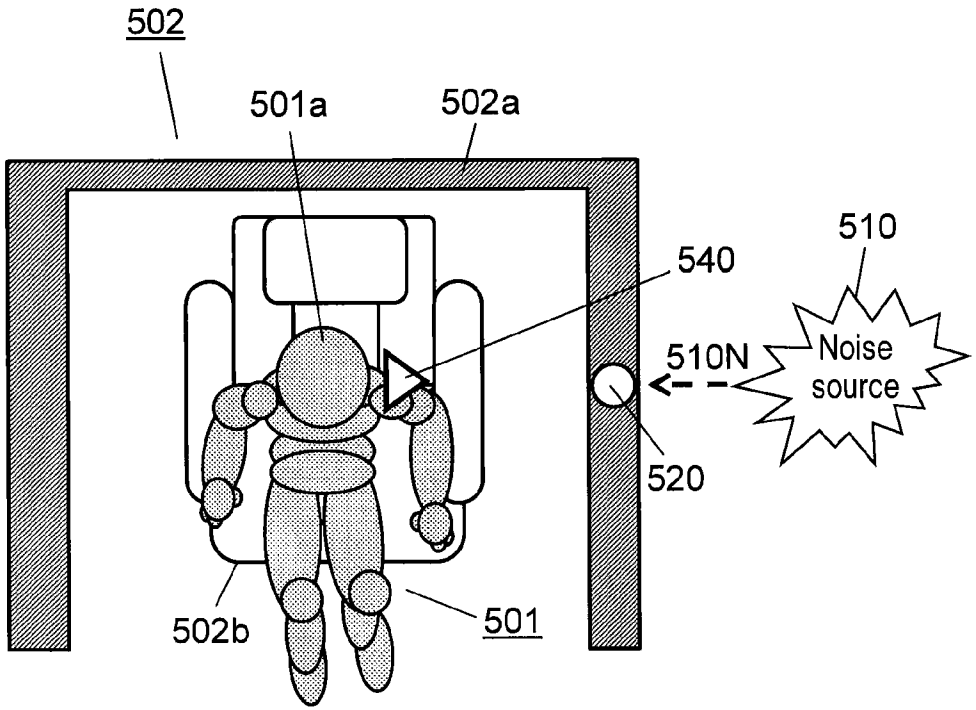
FIG. 5A shows a plan view schematically illustrating an arrangement example of principal structural components of a seat which are installed in the noise reduction apparatus in the embodiment of the present invention.

Next, the arrangements and functions of the principal structural components in the present apparatus are described with reference to FIGS. 5A,5B, taking as an example the case of arranging a microphone for noise detection at the top of the wall surface of the shell section as illustrated in foregoing FIG. 4A. FIG. 5A,5B is a view schematically illustrating an example of arranging the principal structural components of seat 502 installed with the present apparatus, where FIG. 5A is a plan view and FIG. 5B is a side view. In the present apparatus, a seat inside shell section 502*a* is defined as the control space, and the position of the head of the user seated on the seat is defined as a control position as the center of the control space.

In FIGS. 5A and 5B, seat 502 is provided with shell section 502*a* as a structure for partitioning seat 502 and seat section 502*b*, and seat section 502*b* is held in a state where its periphery is surrounded by the wall surface of shell section 502*a* for partitioning from another seat.

For example, physical soundproofing is performed around seat 502 by shell section 502*a* on noise emitted from external noise source 510. Noise from noise source 510 enters inside shell section 502*a* through main arrival channel (noise channel) 510N, to arrive at head (ear) 501*a* of user 501 seated on seat section 502*b*.

Further, in the present apparatus, microphone 520 is installed at the top of the wall surface of shell section 502*a*, so that noise from noise source 510 can be detected with accuracy and reliability. On the other hand, speaker 540 is installed in the vicinity of head (ear) 501*a* (control point) of user 501, and a control sound, generated by a noise controller (not illustrated) so as to have an opposite phase to that of noise, is outputted. Hence a sound arrived from the noise source and a control sound generated from speaker 540 are superimposed on each other so that a noise that arrives at user 501 seated on seat 502 can be efficiently reduced.

Figure 6:
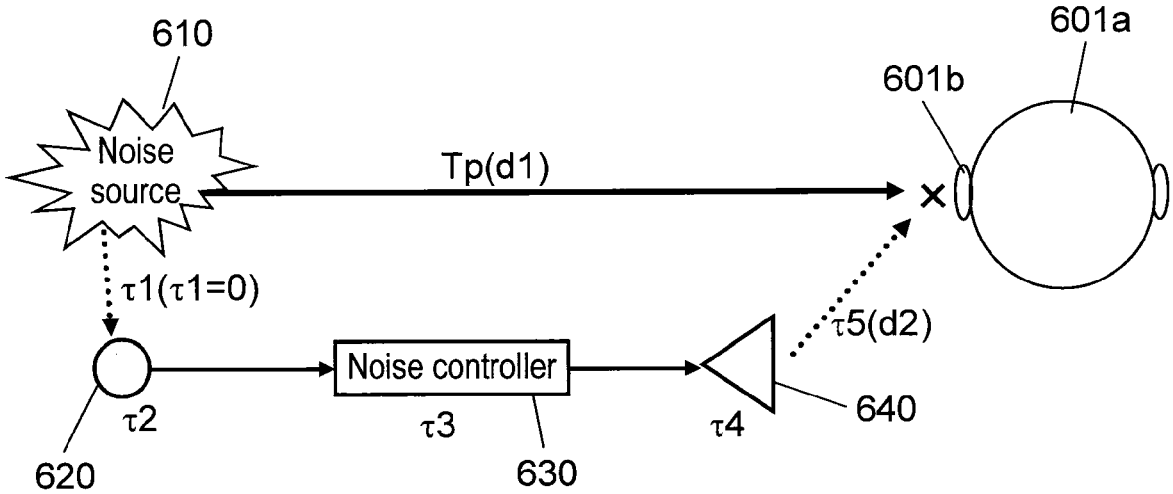
FIG. 6 shows an explanatory diagram concerning arrangement of a microphone for noise detection and a speaker for noise control in the noise reduction apparatus in the embodiment of the present invention.

Next, arrangement of the noise detecting microphone and the control speaker as a structural characteristic of the present apparatus is described with reference to FIG. 6.

In the case of the present apparatus performing the FF (Feed Forward) control with regard to noise reduction, it is necessary to satisfy the limitation (time causality limitation) that a control sound from speaker 640 arrives at control point X simultaneously with arrival thereat of noise emitted from noise source 610. For example, in FIG. 6, it is assume that control point X in the control space is located in the vicinity of ear 610*b* of head 610*a* of the user and speaker 640 for generating a control sound is located on the headrest (FIG. 5) in the seat. It is assumed that the time required by noise to arrive at microphone 620 from noise source 610 is $\tau 1$, the time (delay time) required from inputting to outputting in microphone 620, noise controller 630, and speaker 640 are $\tau 2$, $\tau 3$, $\tau 4$, and the time (control sound transmittance time) taken by a control sound to propagate for distance d2 from speaker 640 to control point X is $\tau 5$ (=d2/v, symbol v indicates acoustic velocity). In this context, a total ($\tau 2+\tau 3+\tau 4$) of the respective delay time of microphone 620, noise controller 630, and speaker 640 is referred to as control delay time.

Incidentally, in a case where identifying the principal noise source is difficult due to the presence of a large number of noise sources as inside the aircraft, processing for noise reduction needs to be performed with the position of microphone 620 regarded as the position of noise source 610. In this case, since time $\tau 1$ required for noise to arrive at microphone 620 from noise source 610 is ignorable, a description is given below with $\tau 1=0$. Time (referred to as control sound delay time) Tq from generation of noise in noise source 610 and detection of the noise in microphone 620 to generation of a control sound by noise controller 630 and emission of the control sound from speaker 640 to arrival at control point X is expressed by: $Tq=\tau 2+\tau 3+\tau 4+\tau 5$. Therefore, in accordance with the time causality limitation in the present apparatus, time (referred to as noise transmittance time) Tp (=d1/v) taken by noise to propagate for distance d1 from noise source 610 (microphone 620) to control point X needs to satisfy the following equation (1):

$$Tp \geqq Tq \quad (1)$$

Accordingly, in the case of performing the FF control in the present apparatus, microphone 620 and speaker 640 may be installed in such positions as to satisfy the condition of the above equation (1).

Figure 7:
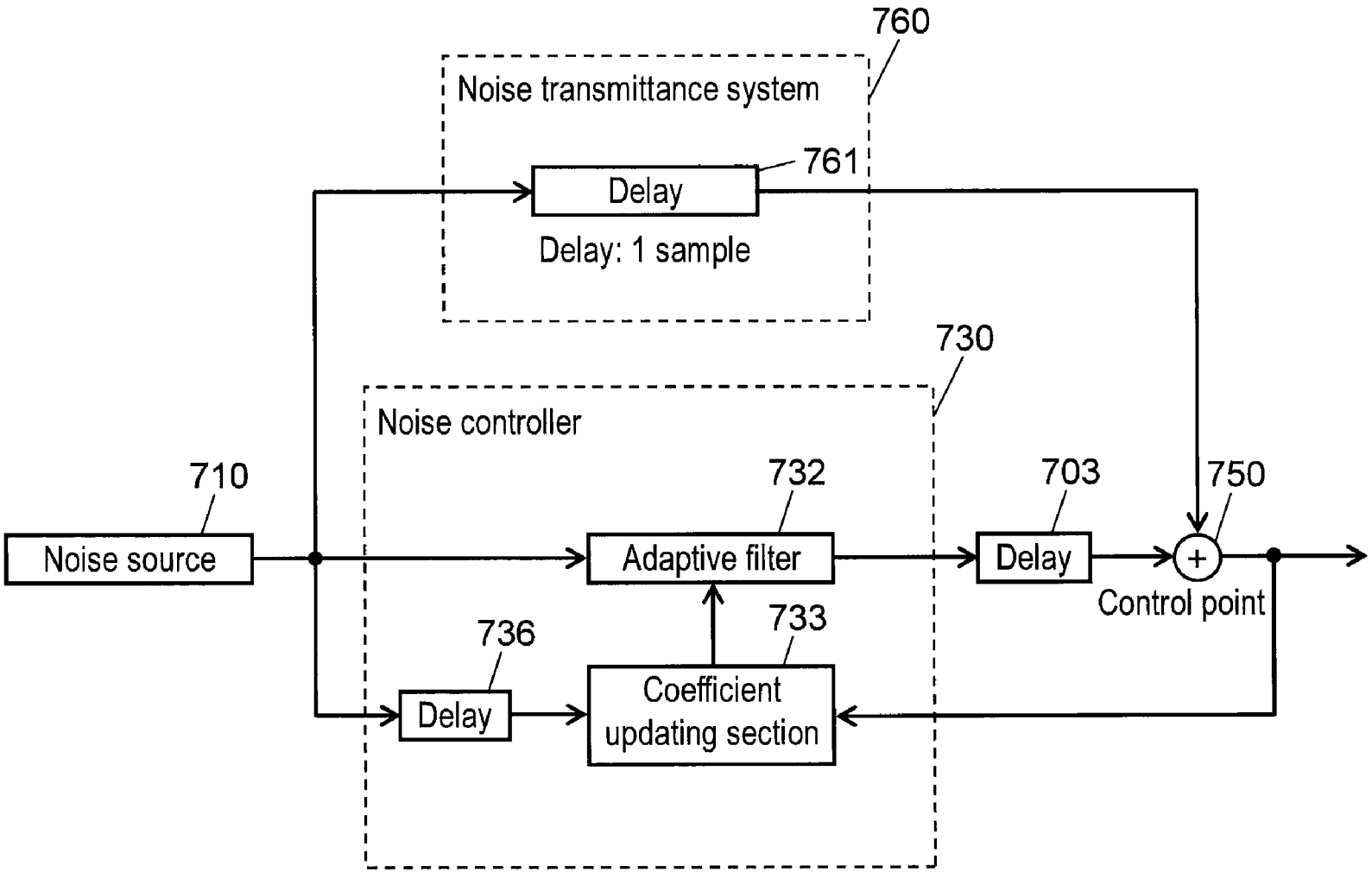
FIG. 7 shows a block diagram for use in a simulation with the noise reduction apparatus in the embodiment of the present invention.
Figure 9A:
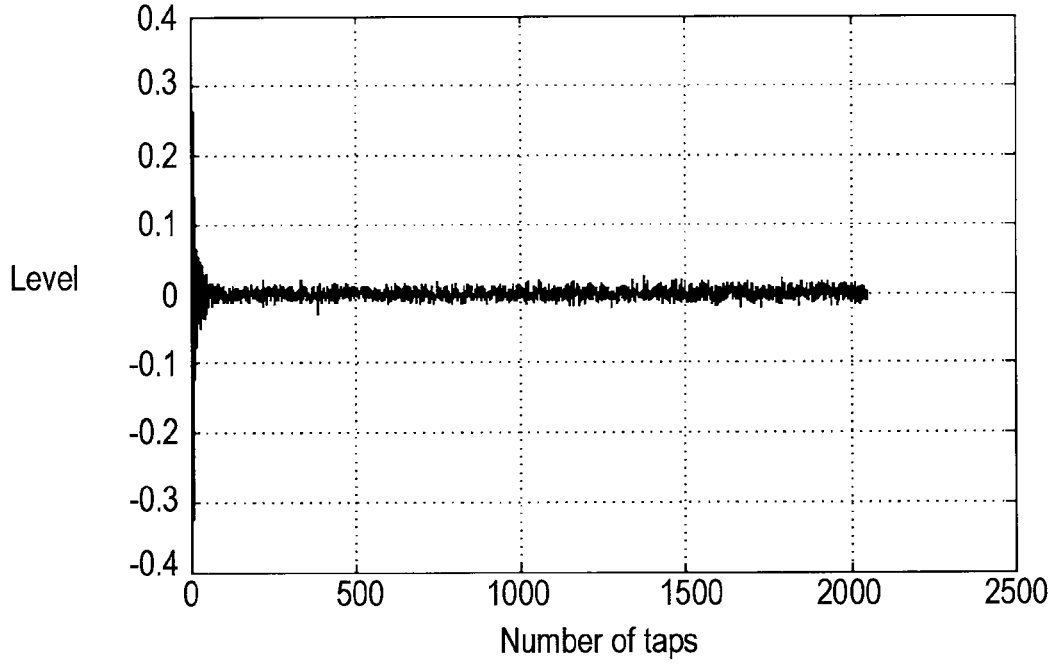
FIG. 9A shows a diagram illustrating a simulation result for the noise reduction effect (case where a noise transmittance system delay=1 sample, and a control sound system delay=2 sample) in the noise reduction apparatus in the embodiment of the present invention, as well as a diagram illustrating a filter coefficient (impulse characteristics) of the adaptive filter, which is generated by the coefficient updating section of the noise controller.
Figure 9B:
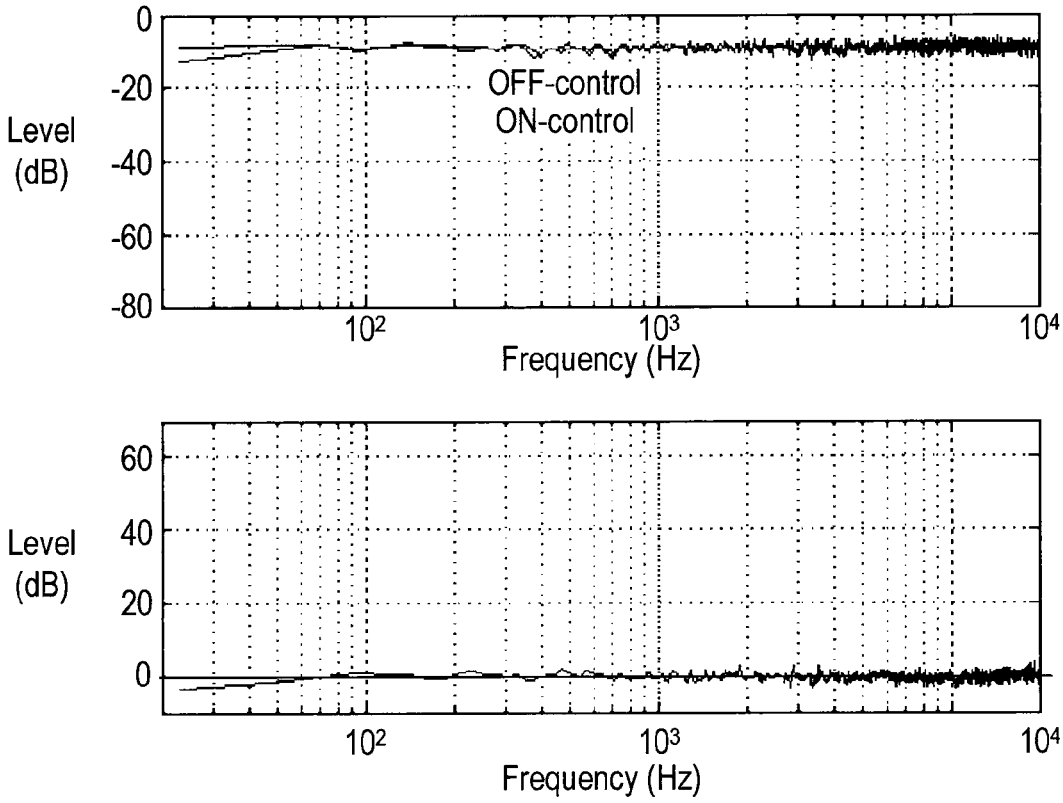
FIG. 9B shows a diagram illustrating a simulation result for the noise reduction effect (case where a noise transmittance system delay=1 sample, and a control sound system delay=2 sample) in the noise reduction apparatus in the embodiment of the present invention, as well as a diagram illustrating the noise reduction effect.
Figure 10:
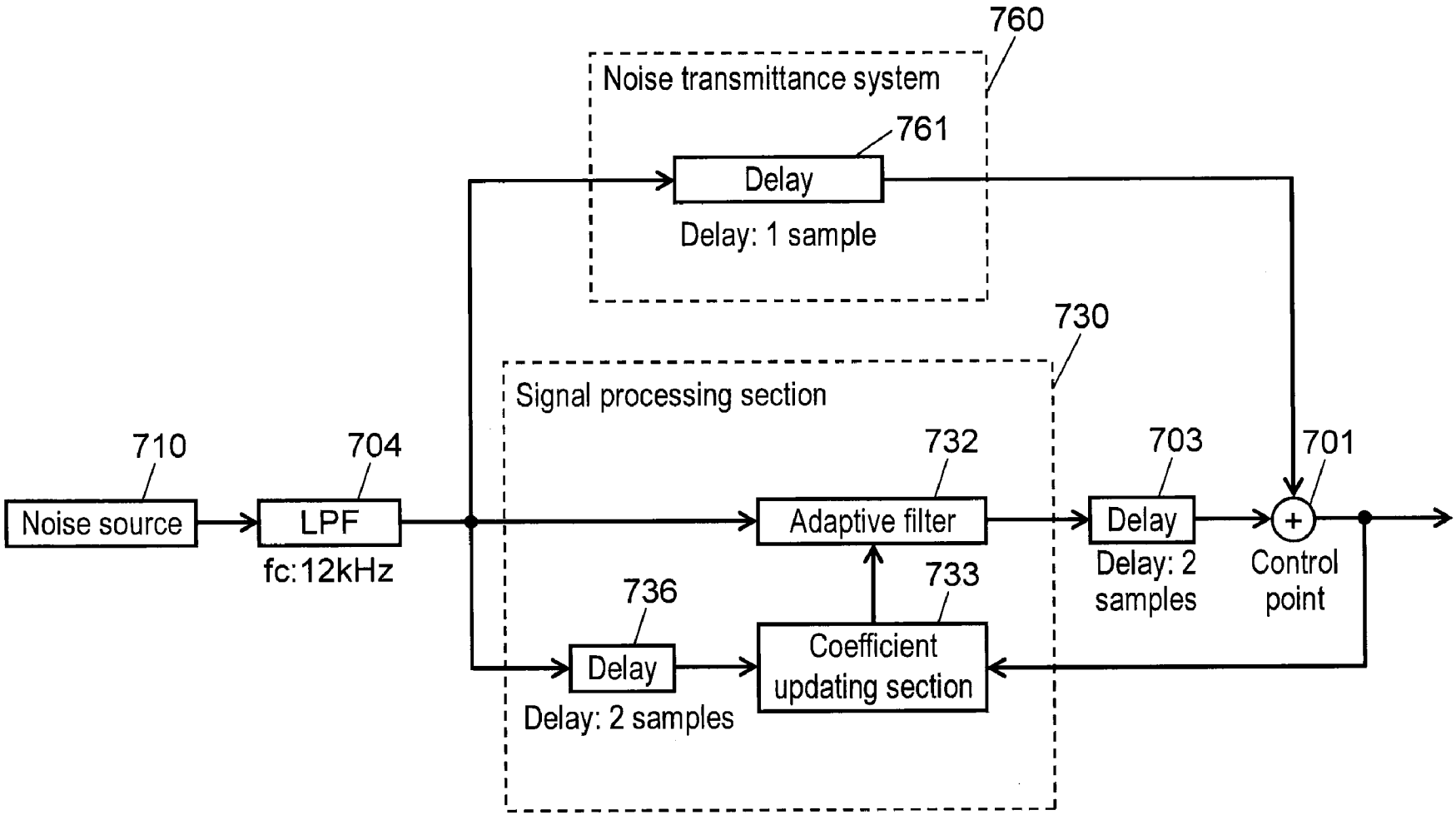
FIG. 10 shows a block diagram for use in a simulation in a case of limiting a control band of the noise reduction apparatus in the embodiment of the present invention.

Next described is the case of not being able to satisfy the equation (1) of the time causality limitation as the object of the present invention. Results of simulations of influences exerted by the relation between noise transmittance time Tp and control sound delay time Tq on the noise reduction effect at the control point are described with reference to FIGS. 7 to 39. FIGS. 7 and 10 are block diagrams of the noise reduction apparatus for use in simulations, and FIGS. 8A, 8B, 9A, 9B and 11 to 38 are diagrams illustrating simulation results for the noise reduction effect at the control point.

In FIG. 7, noise transmittance system 760 (system from noise source 710 to error detecting section 750 installed at the control point) is regarded as delay 761 that is a simple delay (delay is one sample, corresponding to noise transmittance time Tp), a control sound system (system from generation of noise in noise source 710 to arrival of the control sound at error detecting section 750) is similarly regarded as delay 703 that is a simple delay (corresponding to control sound delay time Tq), and noise controller 730 (corresponding to noise controller 330 of FIG. 3) is to perform adaptive processing. Delay 736 of noise controller 730 has the same characteristics as delay 703 of the control sound system, to configure a so-called filtered-X filter. Coefficient updating section 733 (corresponding to coefficient updating section 333 of FIG. 3) updates a coefficient of adaptive filter 732 (corresponding to adaptive filter 332 of FIG. 3) by means of, for example, LMS (Least Mean Square) method.

Figure 8A:
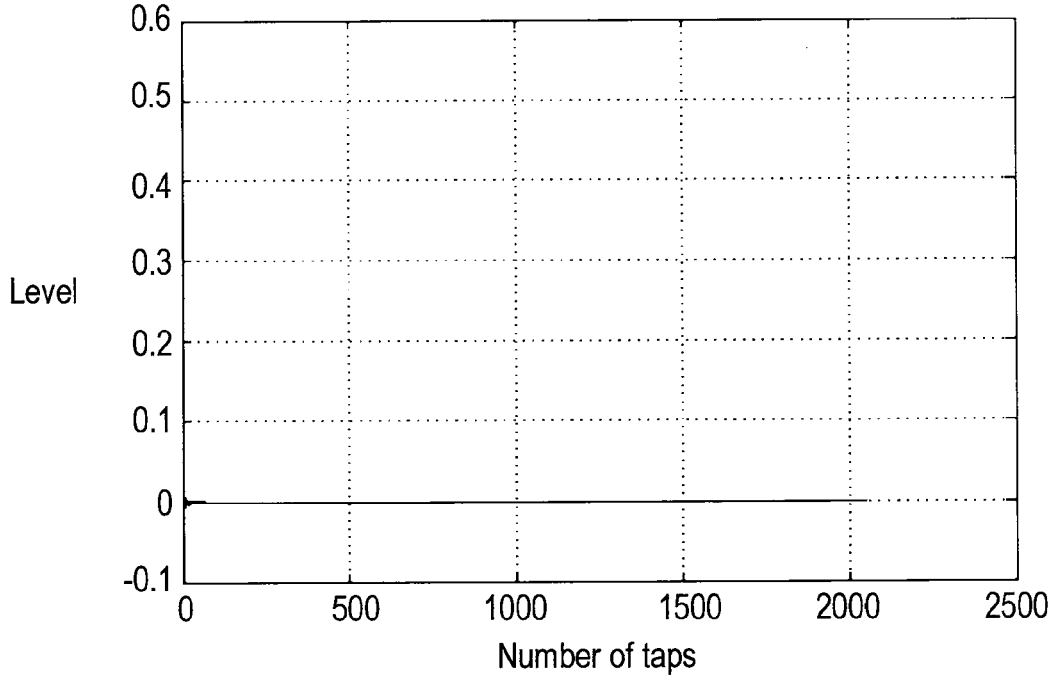
FIG. 8A shows a diagram illustrating a simulation result for a noise reduction effect (case where a noise transmittance system delay=1 sample, and a control sound system delay=1 sample) in the noise reduction apparatus in the embodiment of the present invention, as well as a diagram illustrating a filter coefficient (impulse characteristics) of an adaptive filter, which is generated by a coefficient updating section of a noise controller.
Figure 8B:
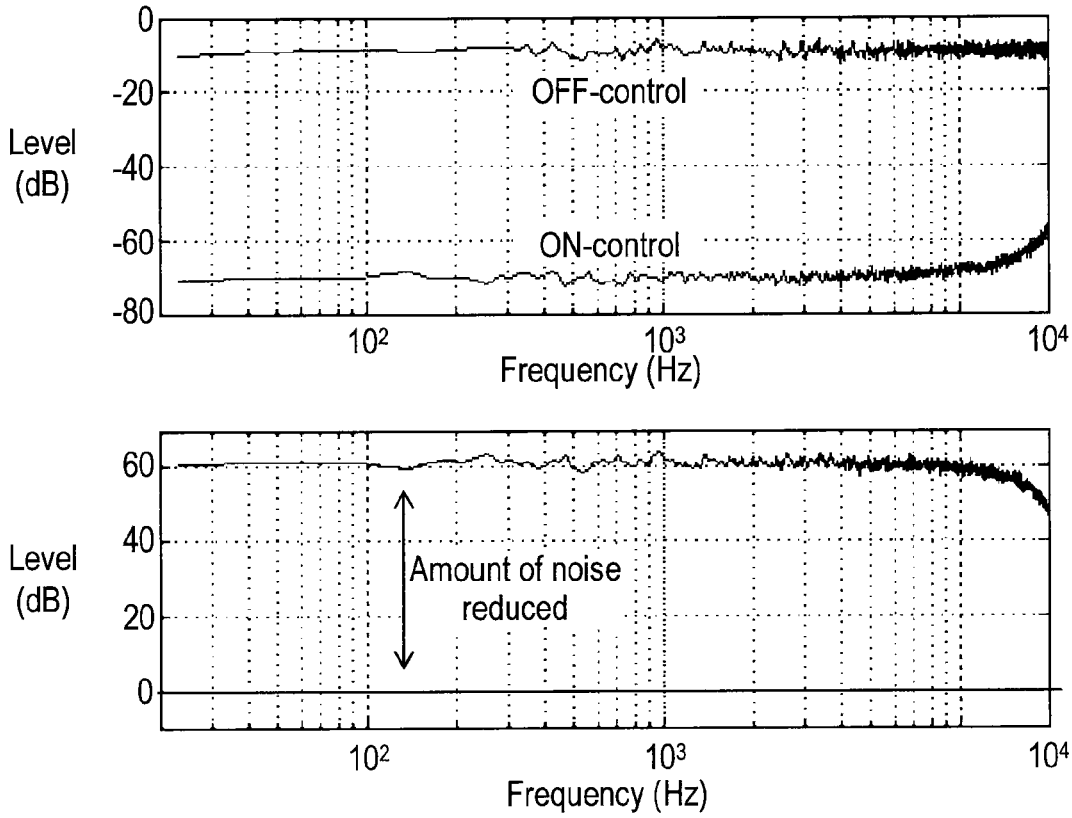
FIG. 8B shows a diagram illustrating a simulation result for the noise reduction effect (case where a noise transmittance system delay=1 sample, and a control sound system delay=1 sample) in the noise reduction apparatus in the embodiment of the present invention, as well as a diagram illustrating the noise reduction effect.

When each of delays 703, 736 is zero to one sample, the processing on adaptive filter 732 as the FF control can be in time. FIG. 8A shows a filter coefficient (impulse characteristics) of adaptive filter 732, which is generated by coefficient updating section 733 of noise controller 730 in the case of delays 703, 736 being one sample, and FIG. 8B is a diagram illustrating a noise reduction effect in that case. In FIG. 8B, the upper diagram indicates noise levels in ON-control and OFF-control of noise reduction, and the lower diagram indicates an amount of noise reduced in ON-control. As illustrated in FIG. 8, in a case where delay 761 of noise transmittance system 760 is one sample and delay 703 of the control sound system and delay 736 of noise controller 730 are both zero to one sample, a sufficient noise control effect (about 60 dB) is obtained in a full frequency band.

Next, when delays 703, 736 are two samples or more, the processing on adaptive filter 732 cannot be in time. FIGS. 9A, 9B are diagrams corresponding to FIGS. 8A, 8B in the case of delays 703, 736 being two samples, and as illustrated in FIGS. 9A, 9B, there is little difference in noise level between ON-control and OFF-control of noise reduction, revealing that no control is exercised. In other words, in the noise reduction apparatus, it is difficult to attempt to reduce noise in a full frequency band on conditions not satisfying the time causality limitation.

Figure 11:
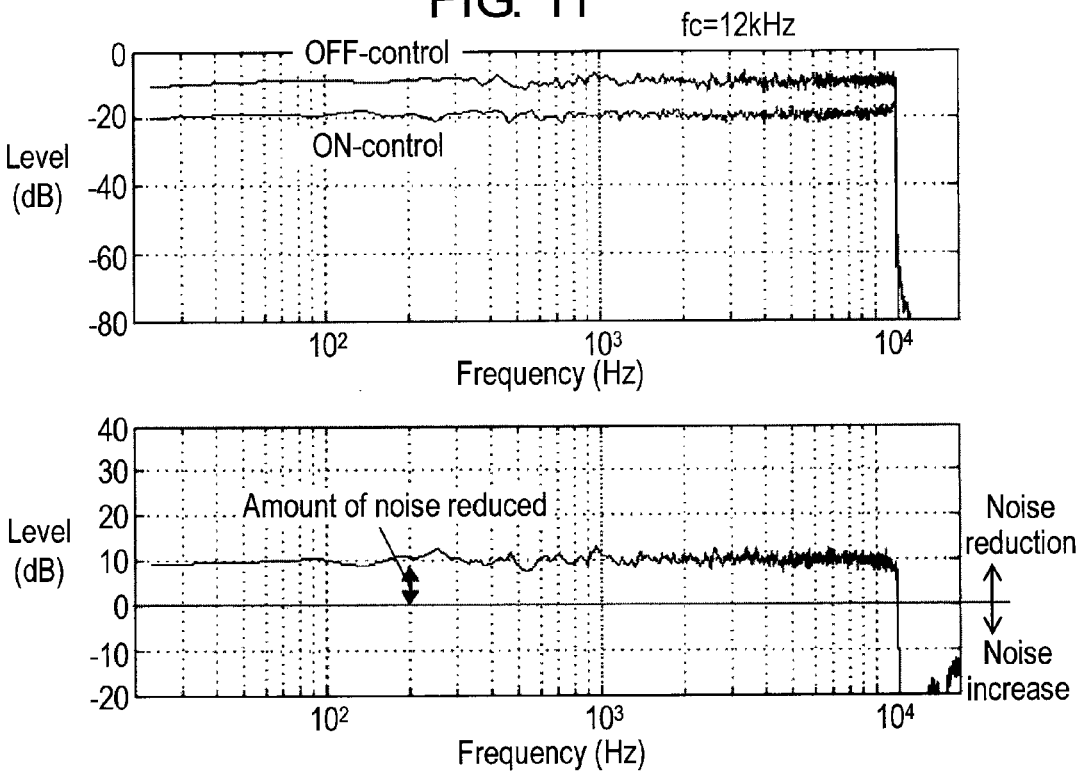
FIG. 11 shows a diagram illustrating a simulation result for the noise reduction effect (case where a noise transmittance system delay=1 sample, a control sound system delay=2 sample, and fc=12 kHz) in the noise reduction apparatus in the embodiment of the present invention.
Figure 12:
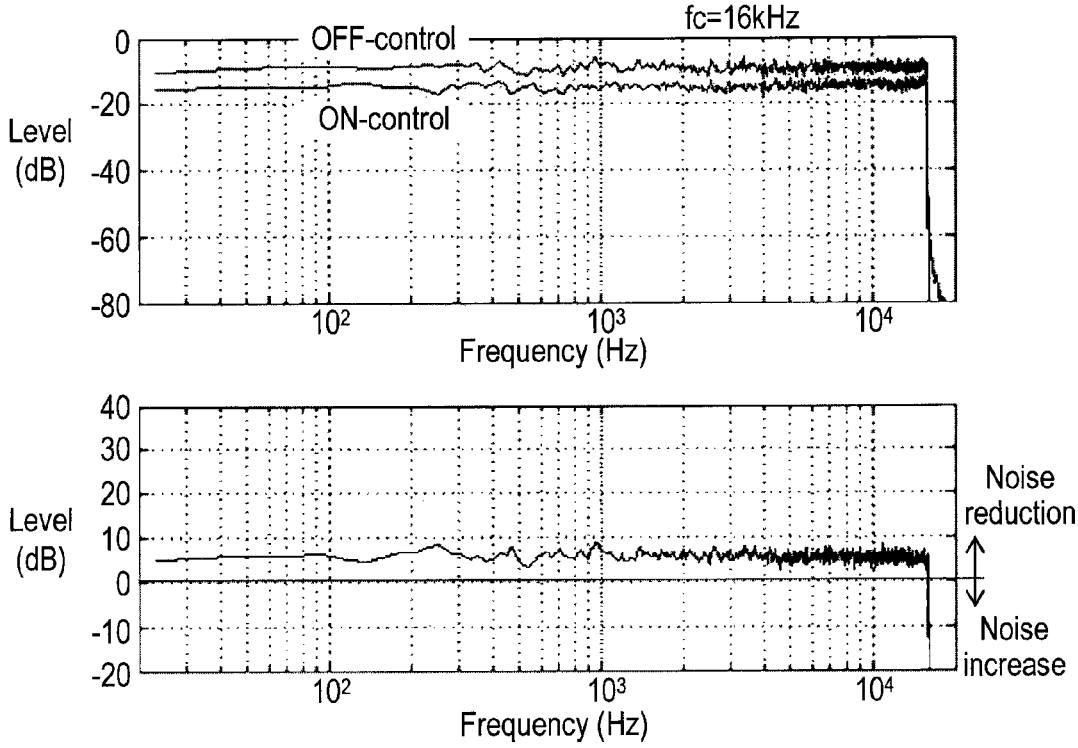
FIG. 12 shows a diagram illustrating a simulation result for the noise reduction effect (case where fc=16 kHz) in the noise reduction apparatus in the embodiment of the present invention.
Figure 13:
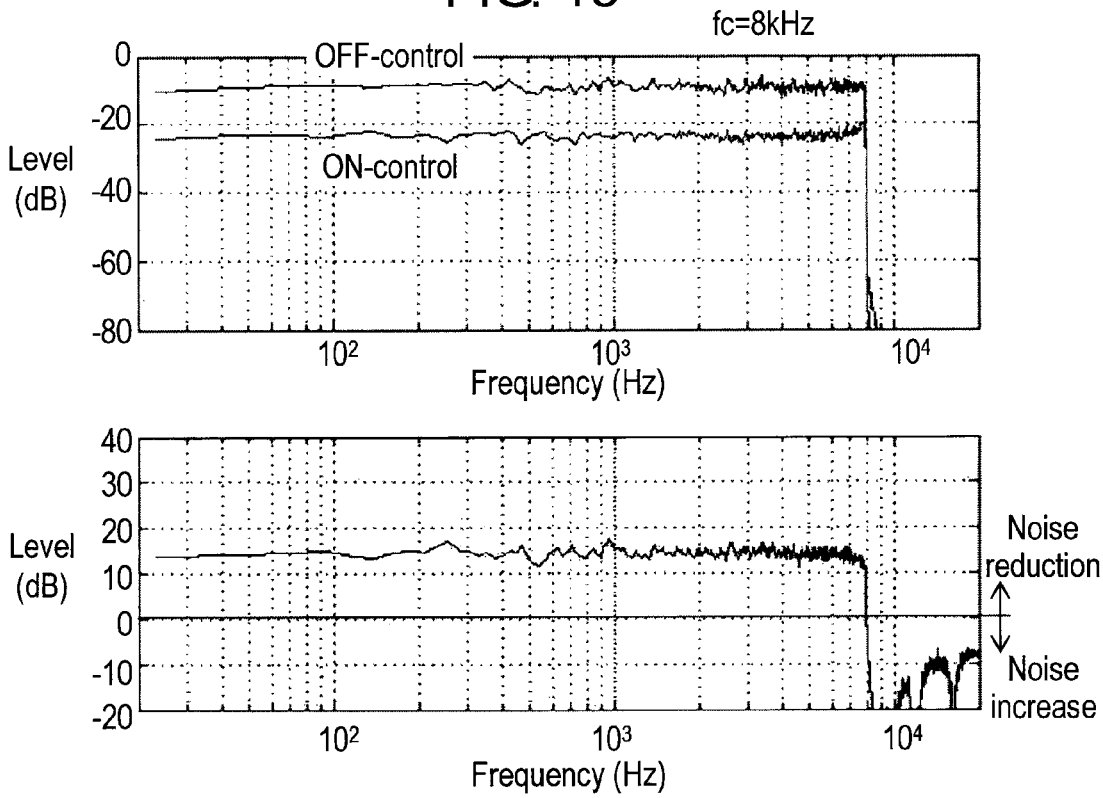
FIG. 13 shows a diagram illustrating a simulation result for the noise reduction effect (case where fc=8 kHz) in the noise reduction apparatus in the embodiment of the present invention.
Figure 14:
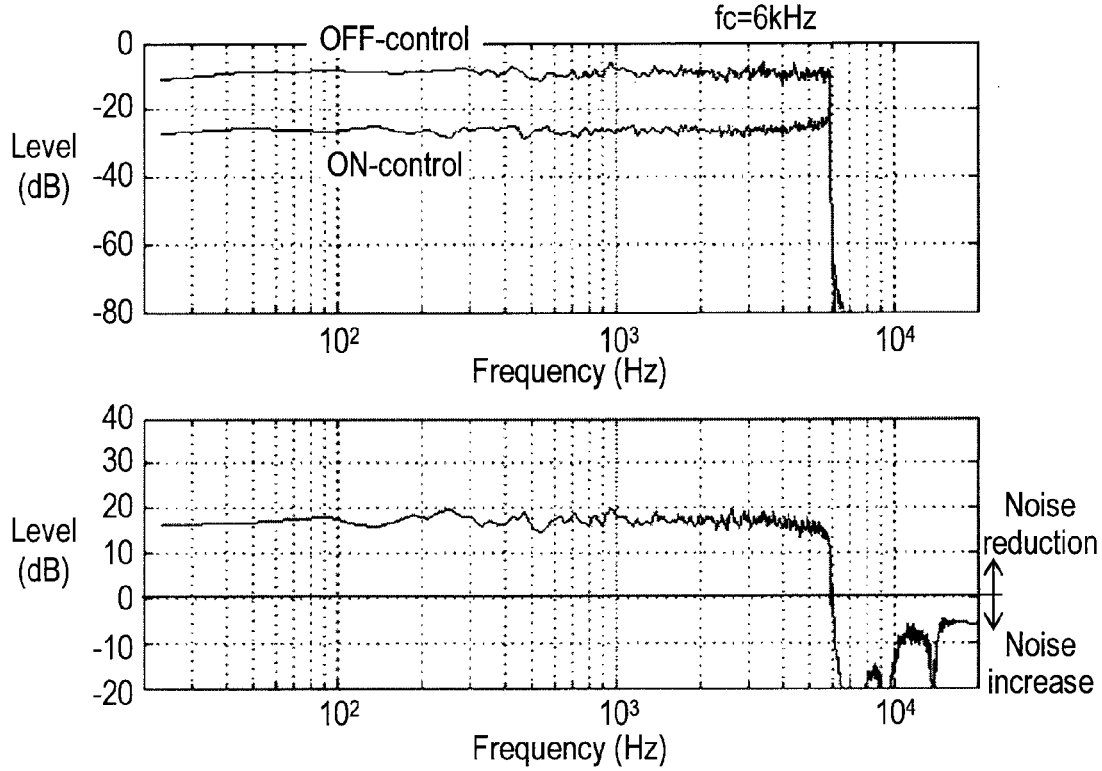
FIG. 14 shows a diagram illustrating a simulation result for the noise reduction effect (case where fc=6 kHz) in the noise reduction apparatus in the embodiment of the present invention.
Figure 15:
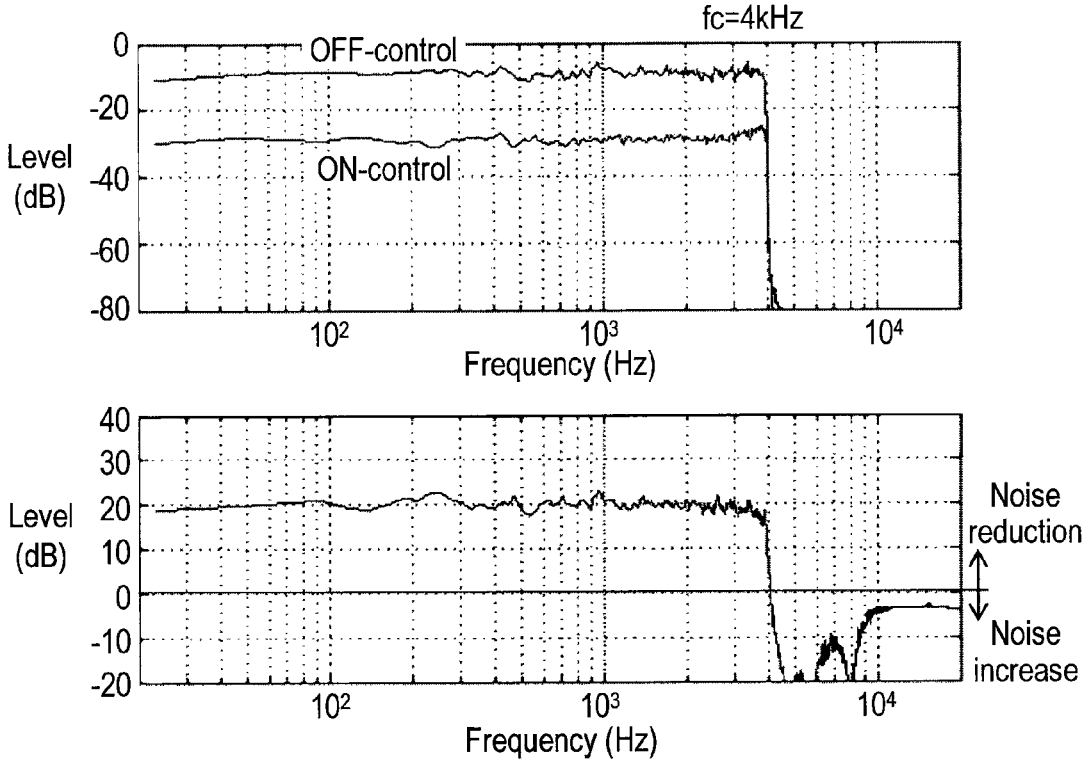
FIG. 15 shows a diagram illustrating a simulation result for the noise reduction effect (case where fc=4 kHz) in the noise reduction apparatus in the embodiment of the present invention.
Figure 16:
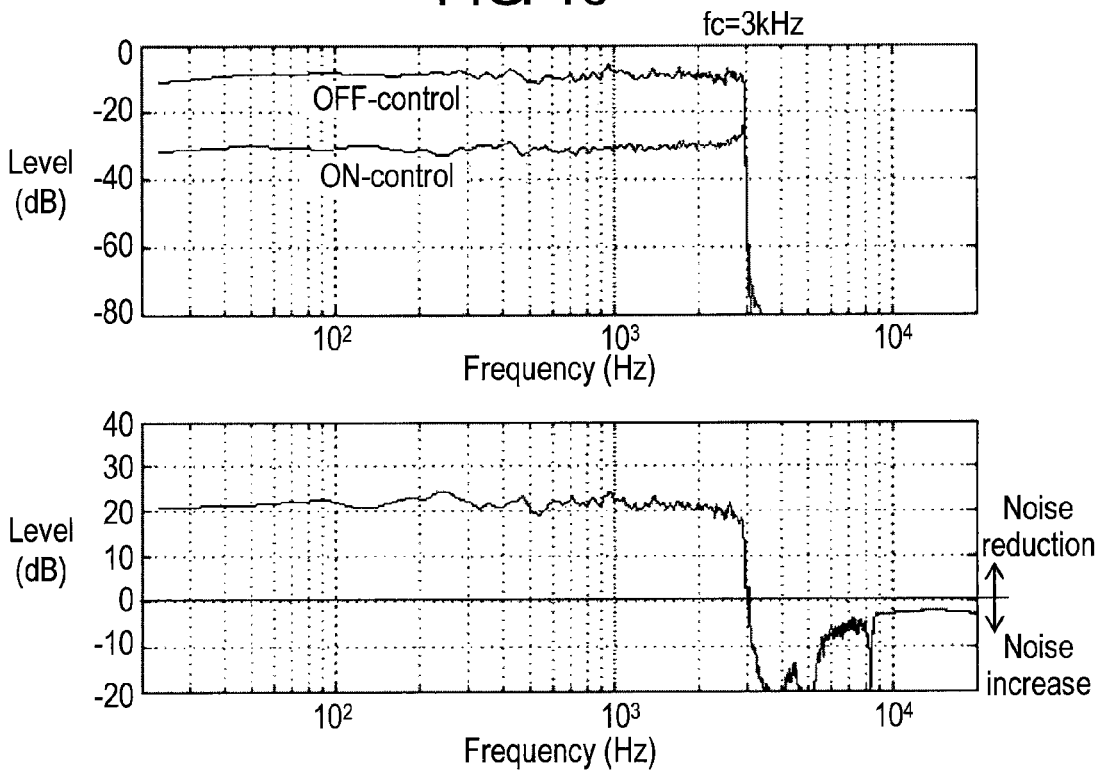
FIG. 16 shows a diagram illustrating a simulation result for the noise reduction effect (case where fc=3 kHz) in the noise reduction apparatus in the embodiment of the present invention.
Figure 17:
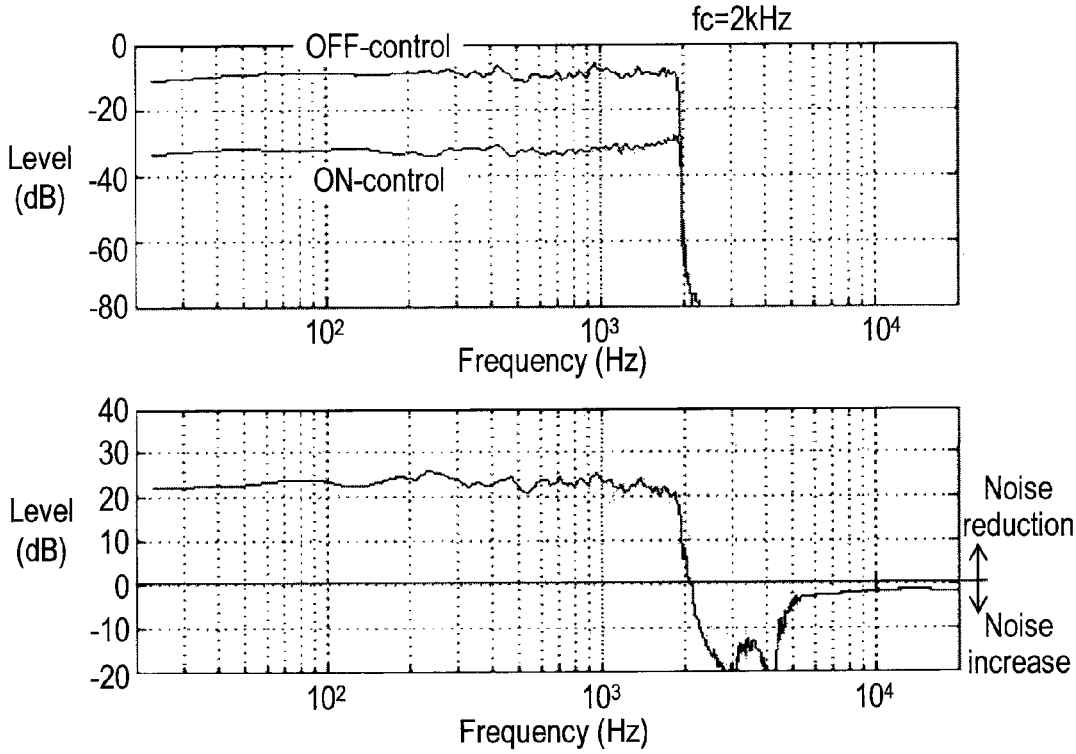
FIG. 17 shows a diagram illustrating a simulation result for the noise reduction effect (case where fc=2 kHz) in the noise reduction apparatus in the embodiment of the present invention.
Figure 18:
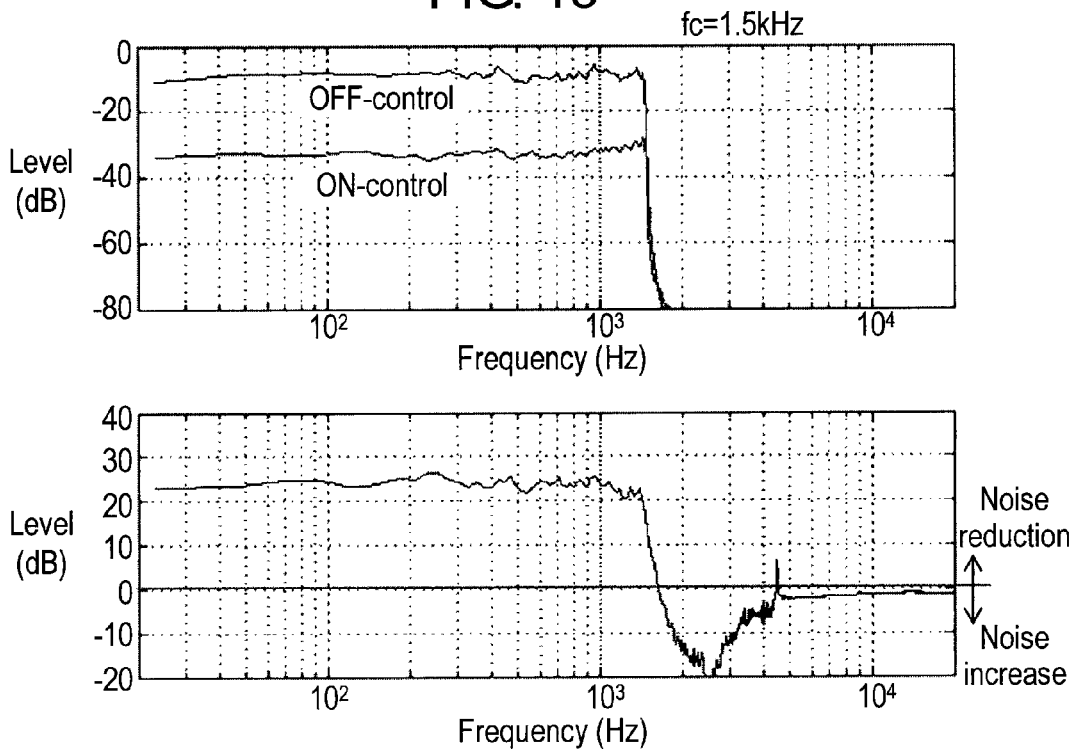
FIG. 18 shows a diagram illustrating a simulation result for the noise reduction effect (case where fc=1.5 kHz) in the noise reduction apparatus in the embodiment of the present invention.
Figure 19:
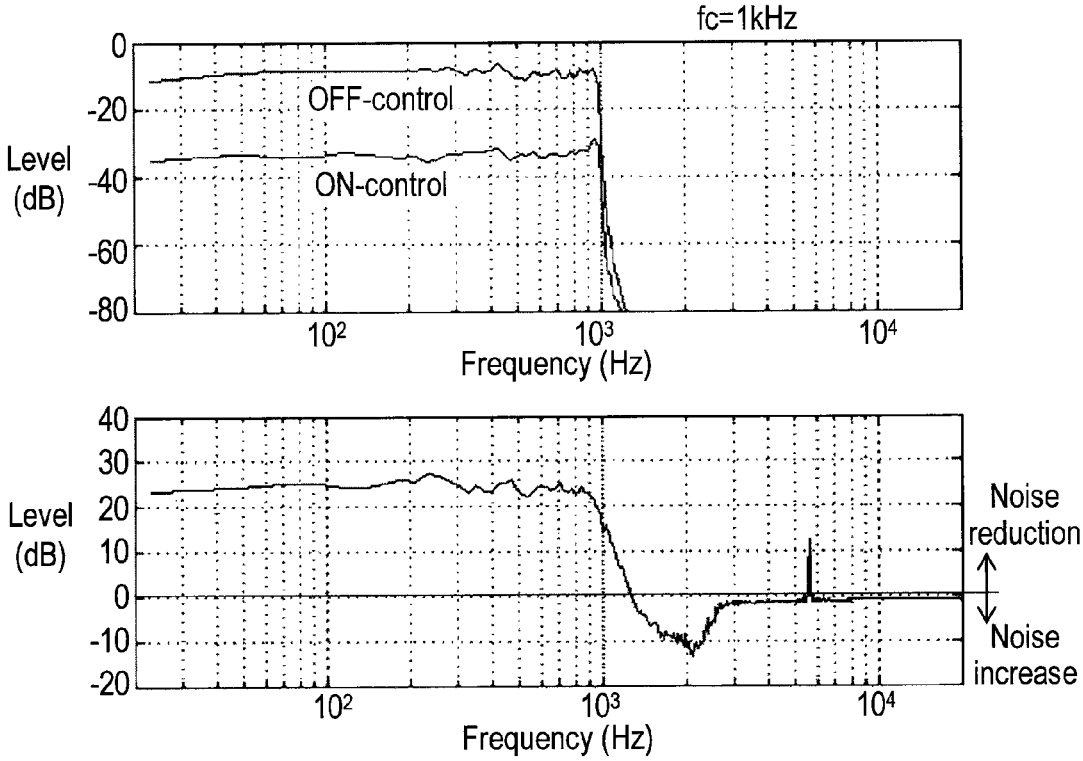
FIG. 19 shows a diagram illustrating a simulation result for the noise reduction effect (case where fc=1 kHz) in the noise reduction apparatus in the embodiment of the present invention.
Figure 20:
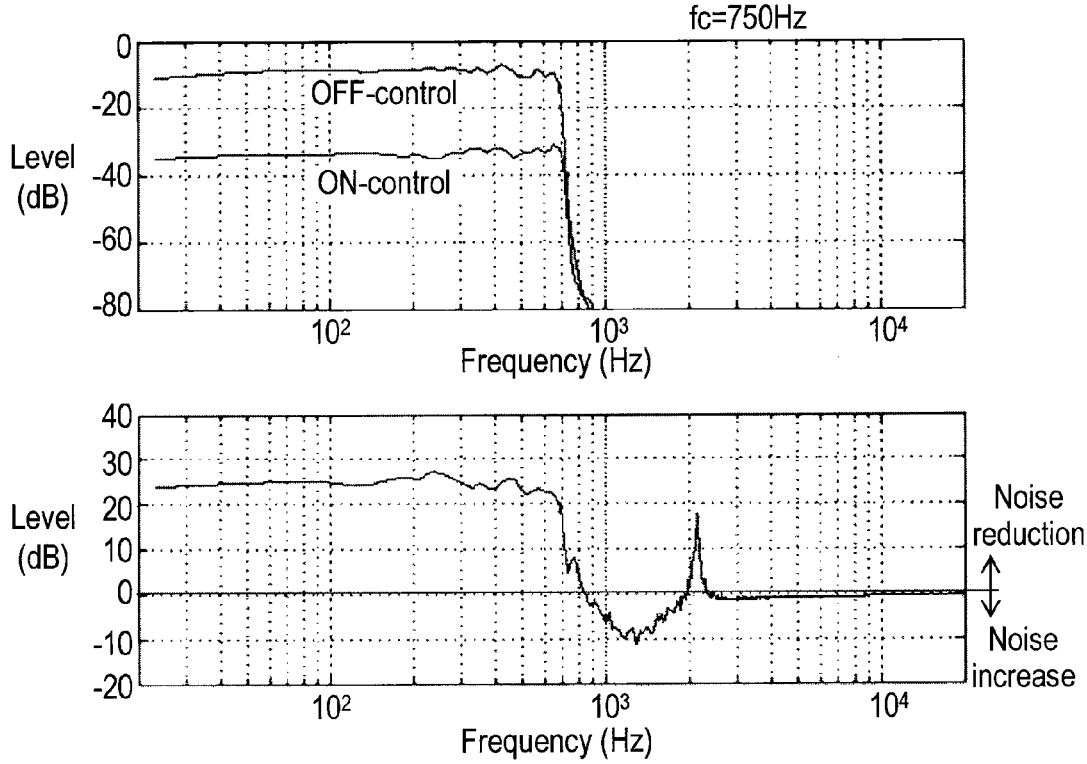
FIG. 20 shows a diagram illustrating a simulation result for the noise reduction effect (case where fc=750 Hz) in the noise reduction apparatus in the embodiment of the present invention.

Then described next is simulation results in the case of limiting the control band for noise reduction. When LPF (Low Pass Filter) 704 is inserted into a noise signal from noise source 710 and the band is then limited with, for example, resonant frequency fc=12 kHz as illustrated in FIG. 10, a reduction effect of about 10 dB is obtained with the resonant frequency being not larger than 12 kHz as illustrated in FIG. 11. As thus described, limiting the control band for noise reduction renders a control effect, and the relation between the control band and the noise reduction effect is verified below. FIG. 12 shows an effect with fc=16 kHz; FIG. 13 shows an effect with fc=8 kHz; FIG. 14 shows an effect with fc=6 kHz; FIG. 15 shows an effect with fc=4 kHz; FIG. 16 shows an effect with fc=3 kHz; FIG. 17 shows an effect with fc=2 kHz; FIG. 18 shows an effect with fc=1.5 kHz; FIG. 19 shows an effect with fc=1 kHz; and FIG. 20 shows an effect with fc=750 Hz.

Incidentally, the difference between delay 761 of the noise transmittance system and delay 703 of the control sound system in FIG. 10 is set as one sample, and when a sampling frequency is fs=48 kHz and a difference sample is one period Td, frequency fd is: fd=1/Td=48 kHz. Meanwhile, at the time when resonant frequency fc of LPF 704: fc=16 kHz is set as one wavelength, a wavelength of fd is fc/fd=⅓, namely, a one-third wavelength, in accordance with $\lambda=v/f$ (v: sound velocity). Similarly, a wavelength of fd at the time of resonant frequency fc=12 kHz being set as one wavelength is a one-quarter wavelength, a wavelength of fd at the time of resonant frequency fc=8 kHz being set as one wavelength is a one-sixth wavelength, a wavelength of fd at the time of resonant frequency fc=6 kHz being set as one wavelength is a one-eighth wavelength, . . . . Results of plotting then amounts of noise reduced from FIGS. 11 to 20 are summarized in FIG. 21. It is to be noted that the range of frequencies evaluated as the noise reduction effect is a band not larger than fc. This is because the accuracy is not gained in a band not smaller than fc due to a level decrease.

Figure 22:
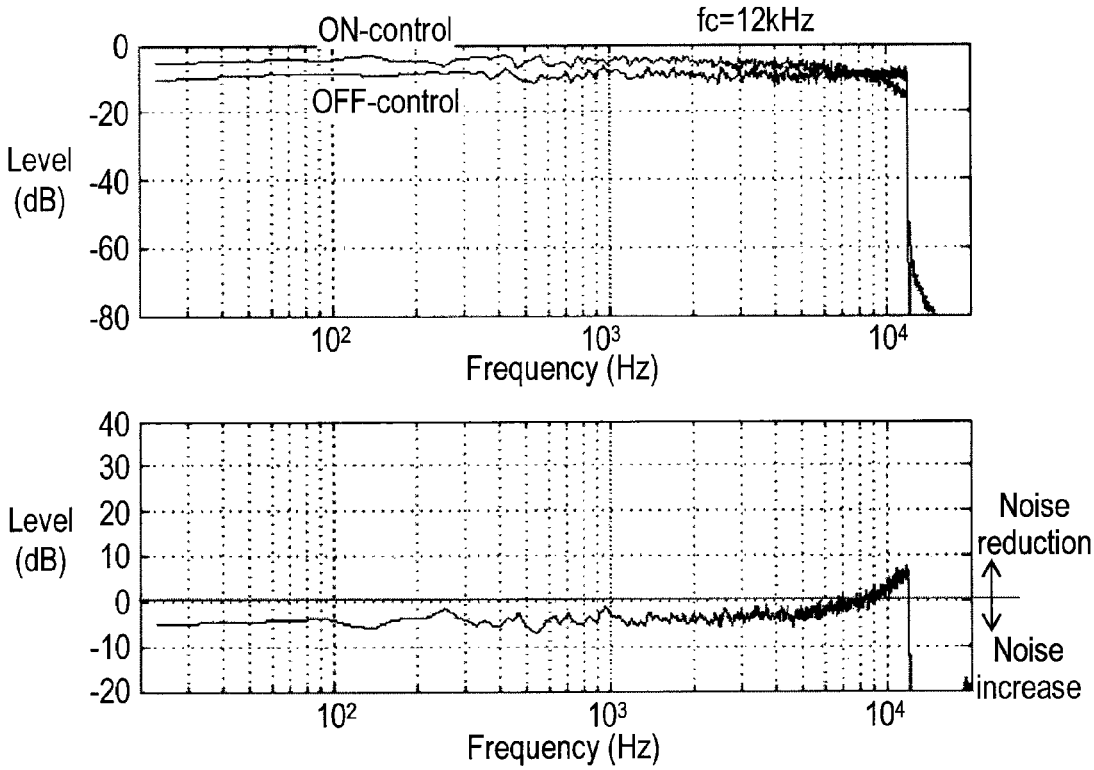
FIG. 22 shows a diagram illustrating a simulation result for the noise reduction effect (case where a noise transmittance system delay=1 sample, a control sound system delay=5 sample, and fc=12 kHz) in the noise reduction apparatus in the embodiment of the present invention.
Figure 23:
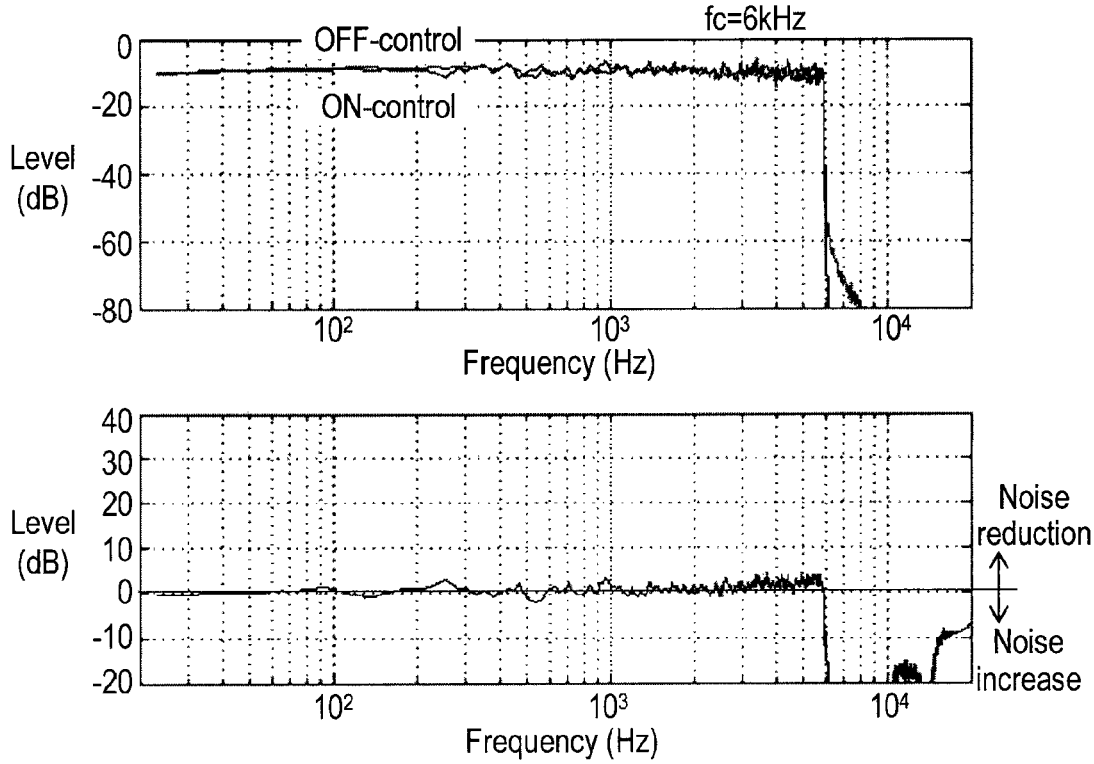
FIG. 23 shows a diagram illustrating a simulation result for the noise reduction effect (case where fc=6 kHz) in the noise reduction apparatus in the embodiment of the present invention.
Figure 24:
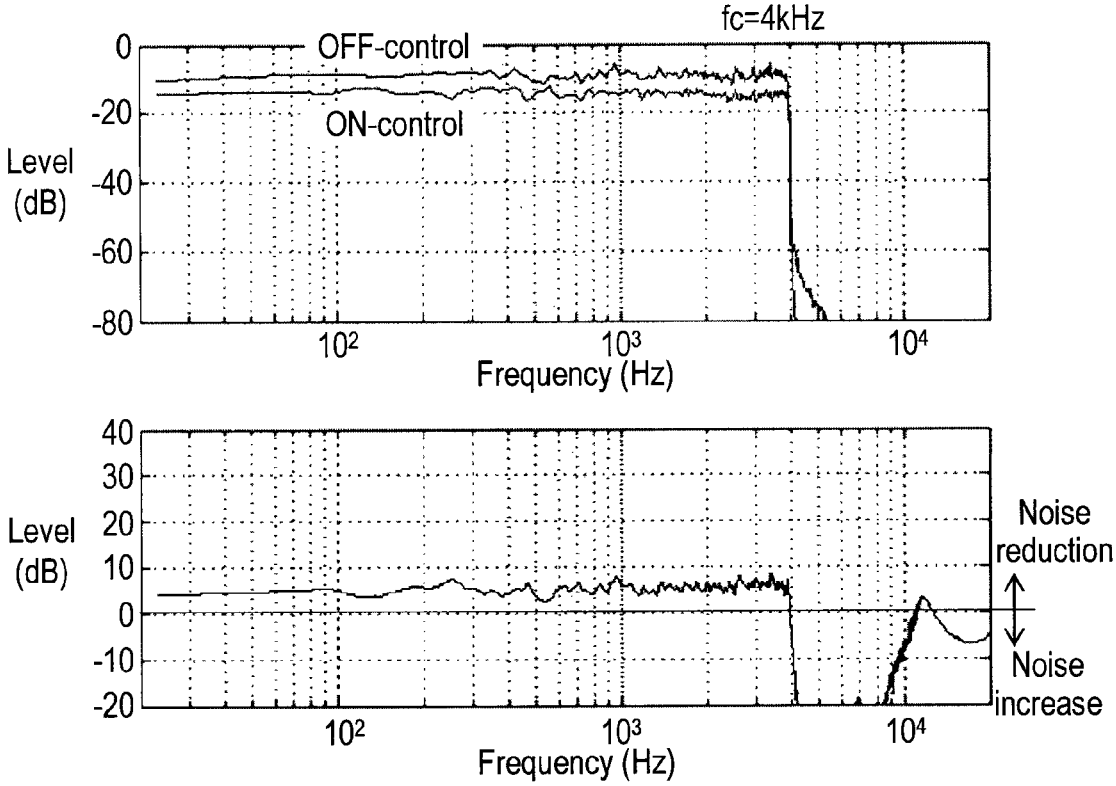
FIG. 24 shows a diagram illustrating a simulation result for the noise reduction effect (case where fc=4 kHz) in the noise reduction apparatus in the embodiment of the present invention.
Figure 25:
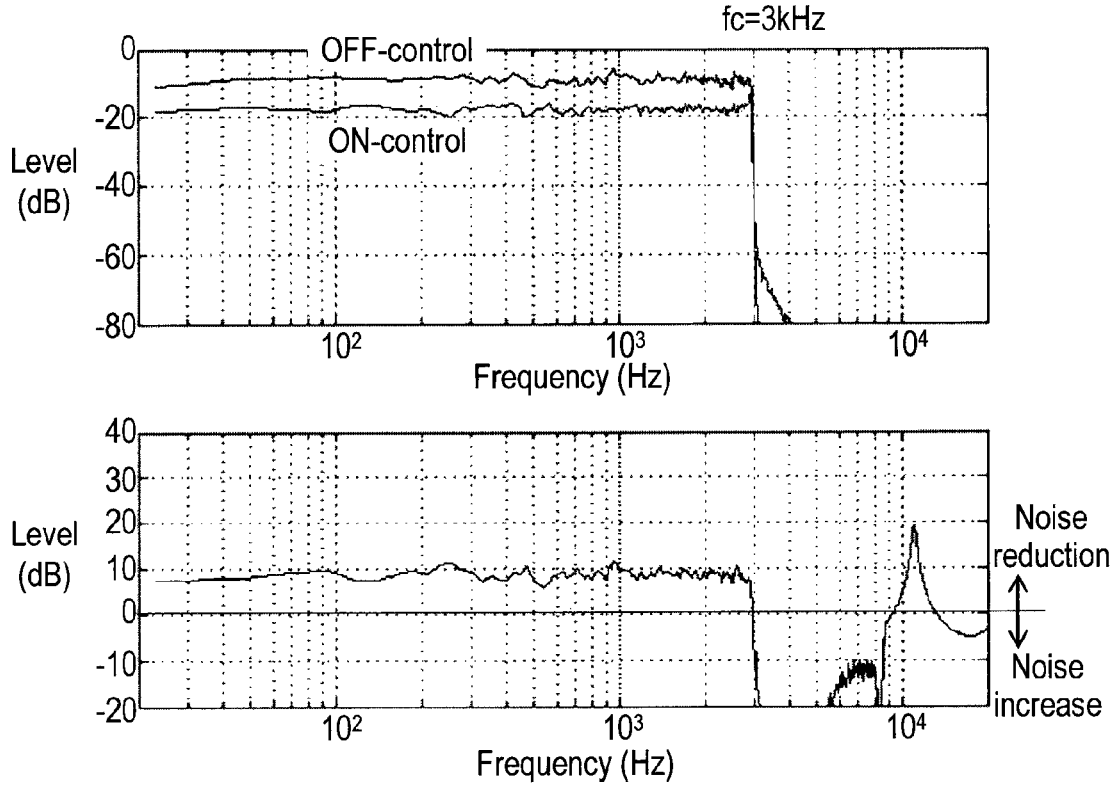
FIG. 25 shows a diagram illustrating a simulation result for the noise reduction effect (case where fc=3 kHz) in the noise reduction apparatus in the embodiment of the present invention.
Figure 26:
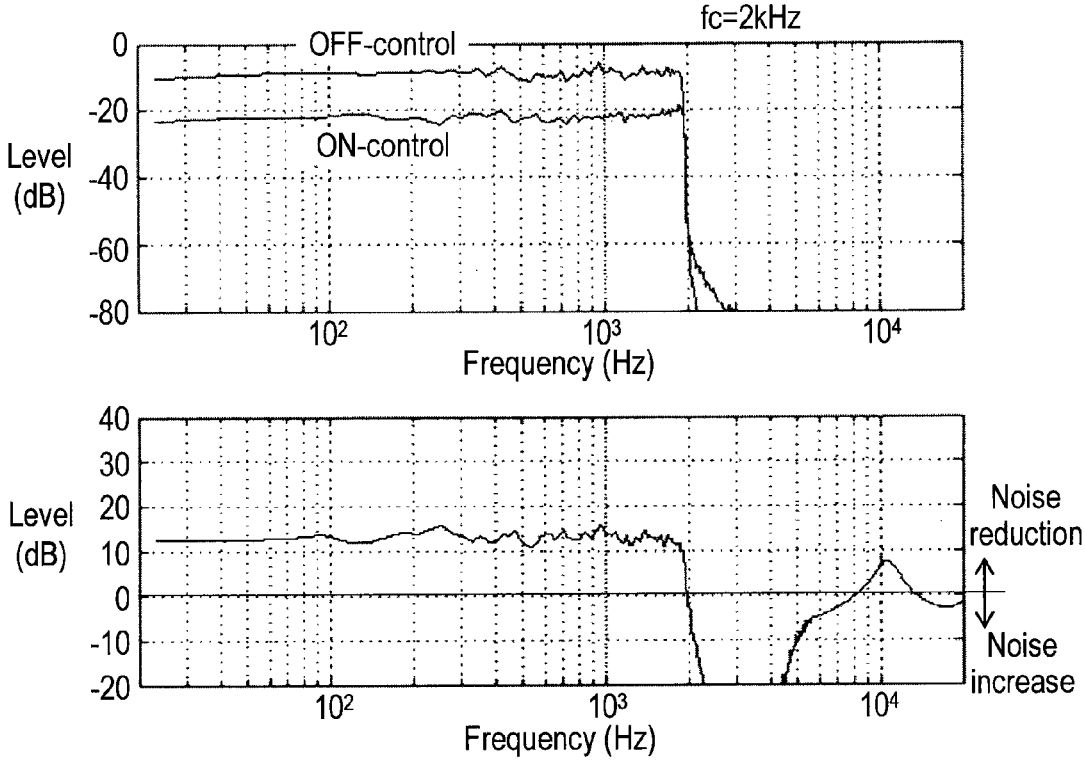
FIG. 26 shows a diagram illustrating a simulation result for the noise reduction effect (case where fc=2 kHz) in the noise reduction apparatus in the embodiment of the present invention.
Figure 27:
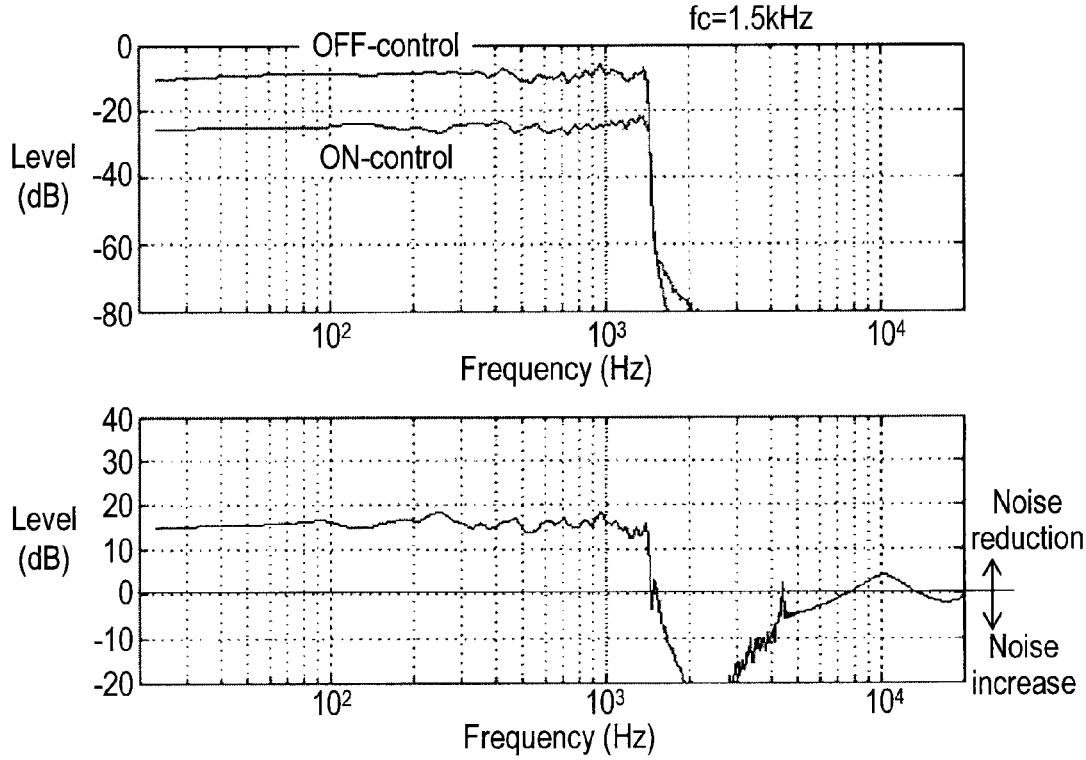
FIG. 27 shows a diagram illustrating a simulation result for the noise reduction effect (case where fc=1.5 kHz) in the noise reduction apparatus in the embodiment of the present invention.
Figure 28:
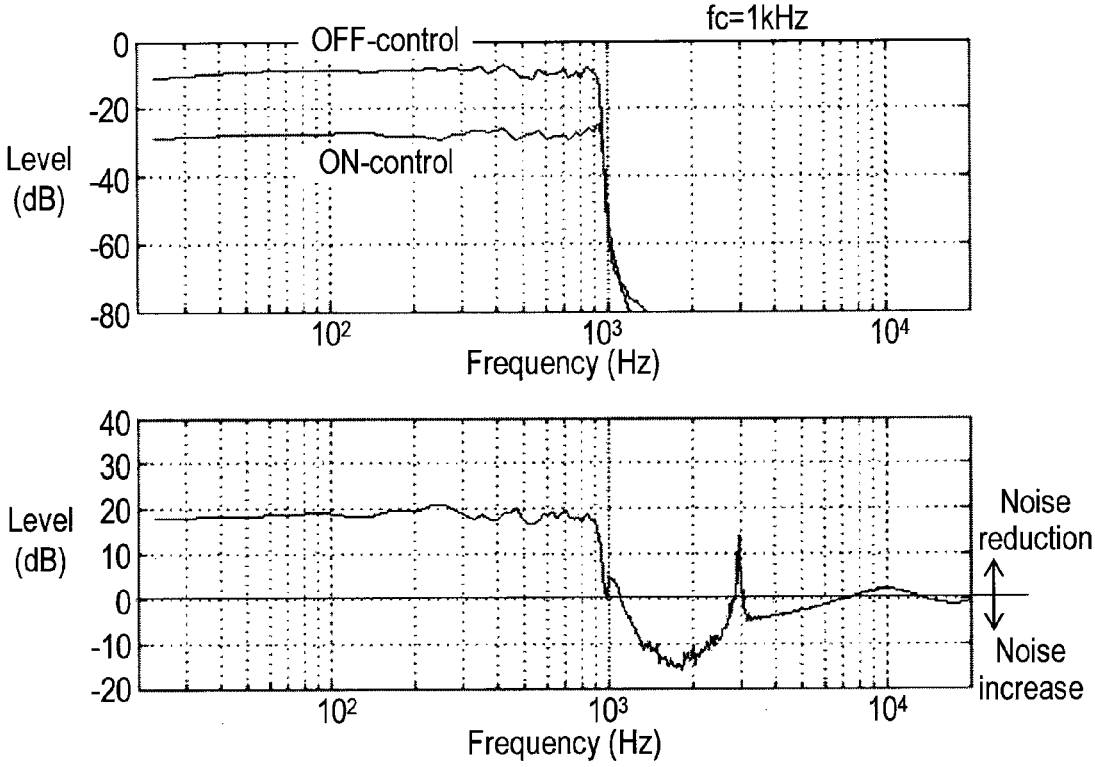
FIG. 28 shows a diagram illustrating a simulation result for the noise reduction effect (case where fc=1 kHz) in the noise reduction apparatus in the embodiment of the present invention.
Figure 29:
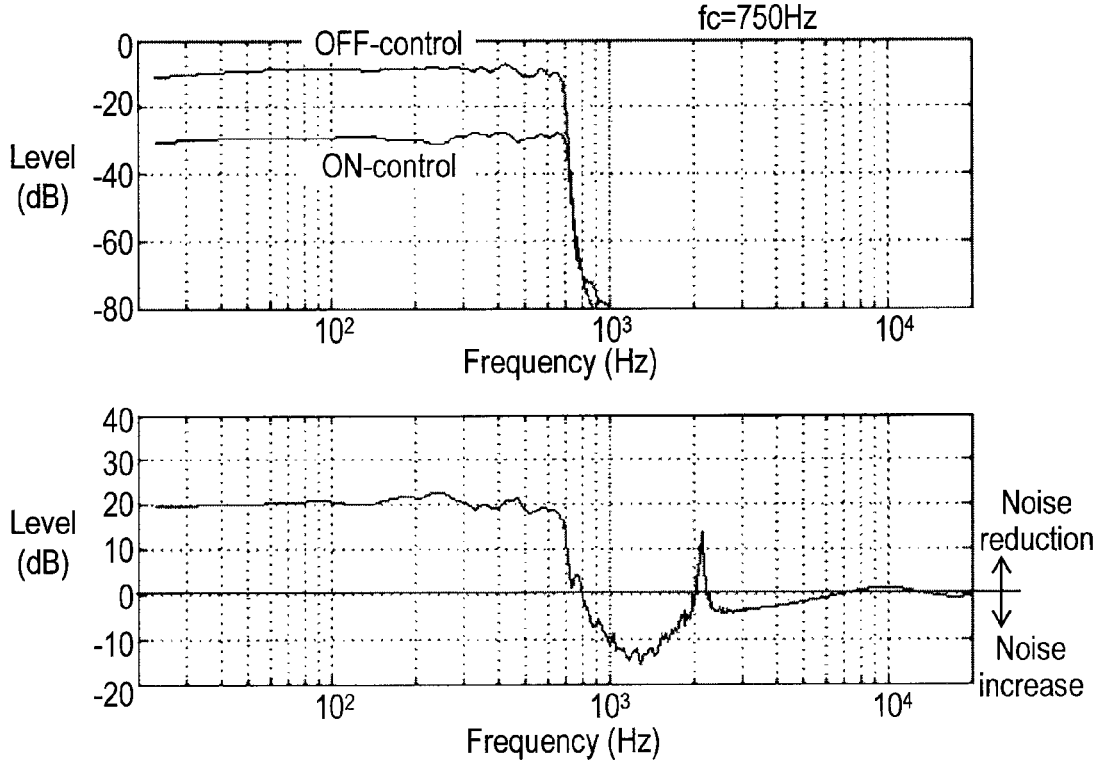
FIG. 29 shows a diagram illustrating a simulation result for the noise reduction effect (case where fc=750 Hz) in the noise reduction apparatus in the embodiment of the present invention.

Next, the relation between the control band and the noise reduction effect in the case of further increasing the delay of delay 703 in FIG. 10 is described. In setting of the delay of delay 703 in FIG. 10 as five samples, FIG. 22 shows an effect with fc=12 kHz; FIG. 23 shows an effect with fc=6 kHz; FIG. 24 shows an effect with fc=4 kHz; FIG. 25 shows an effect with fc=3 kHz; FIG. 26 shows an effect with fc=2 kHz; FIG. 27 shows an effect with fc=1.5 kHz; FIG. 28 shows an effect with fc=1 kHz; FIG. 29 shows an effect with fc=750 Hz; and FIG. 30 shows a result of summarizing those.

Figure 31:
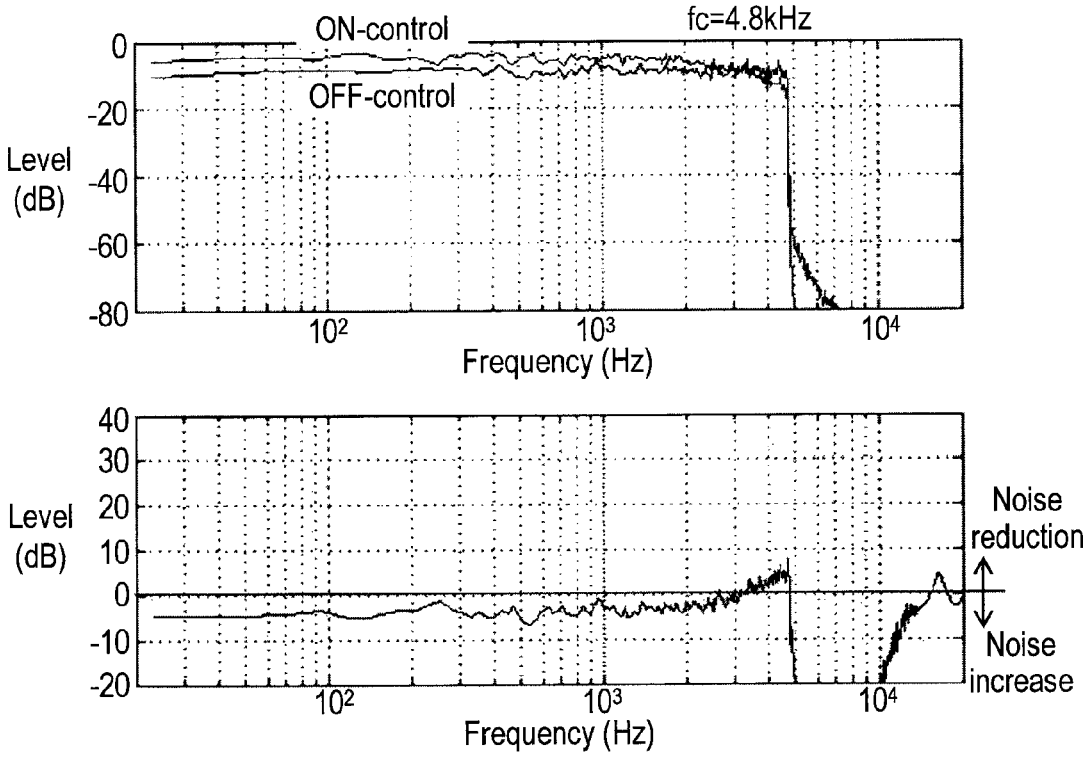
FIG. 31 shows a diagram illustrating a simulation result for the noise reduction effect (case where a noise transmittance system delay=1 sample, a control sound system delay=11 sample, and fc=4.8 kHz) in the noise reduction apparatus in the embodiment of the present invention.
Figure 32:
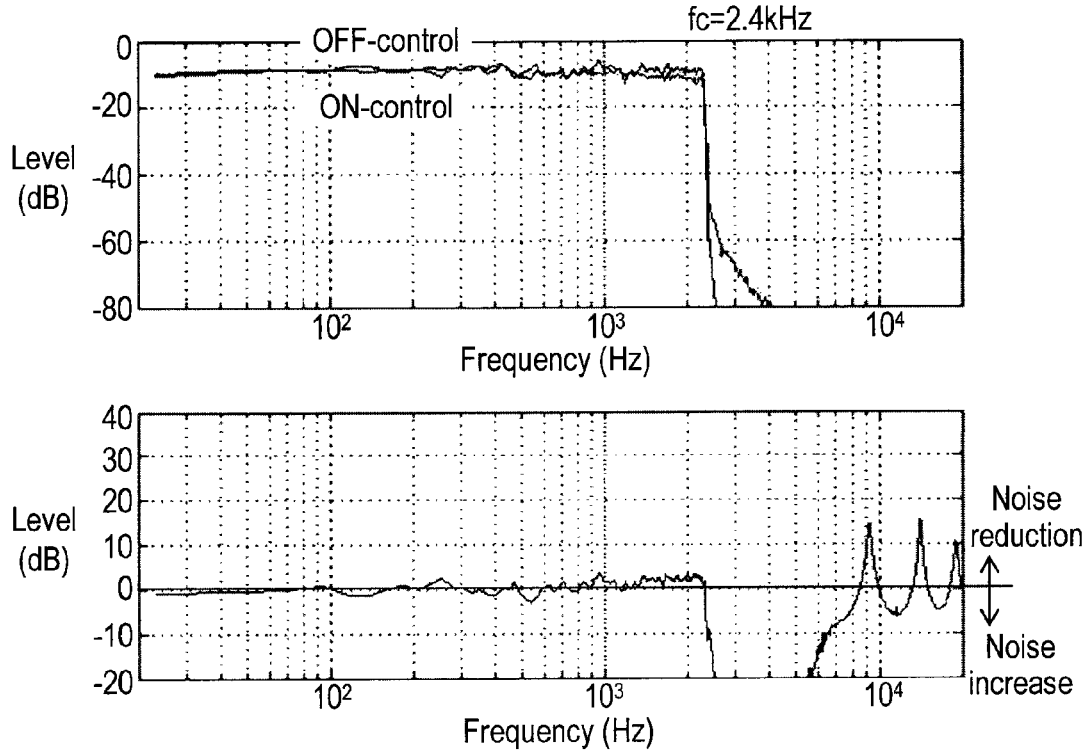
FIG. 32 shows a diagram illustrating a simulation result for the noise reduction effect (case where fc=2.4 kHz) in the noise reduction apparatus in the embodiment of the present invention.
Figure 33:
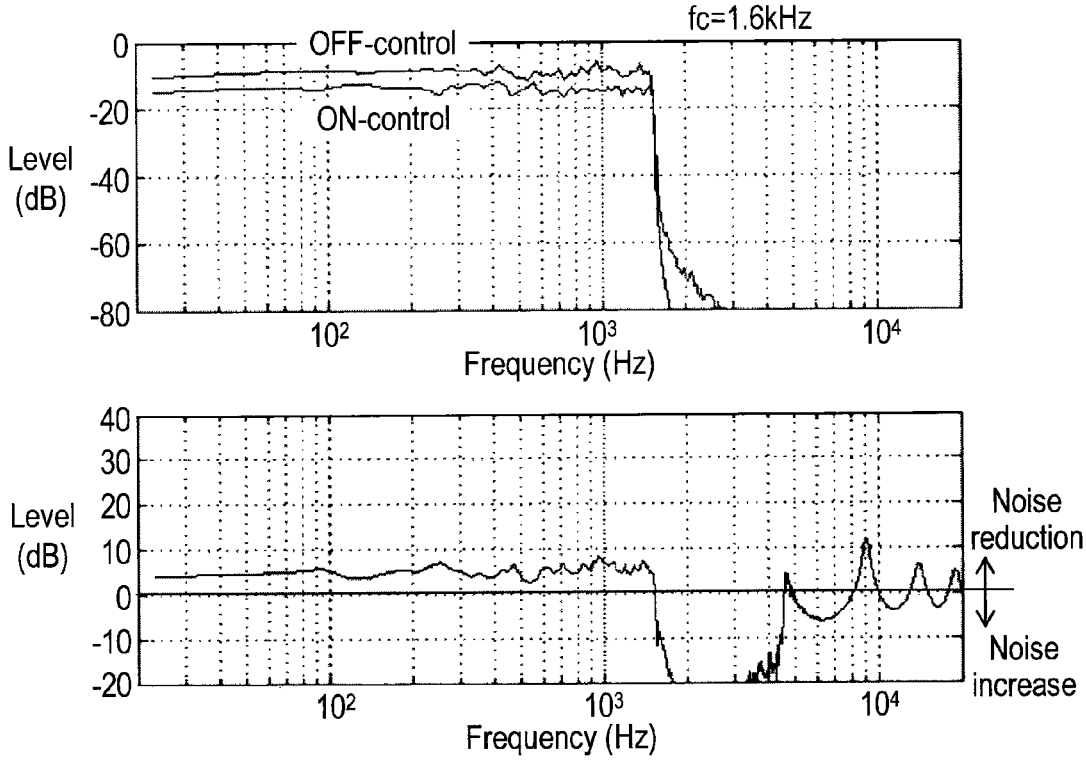
FIG. 33 shows a diagram illustrating a simulation result for the noise reduction effect (case where fc=1.6 kHz) in the noise reduction apparatus in the embodiment of the present invention.
Figure 34:
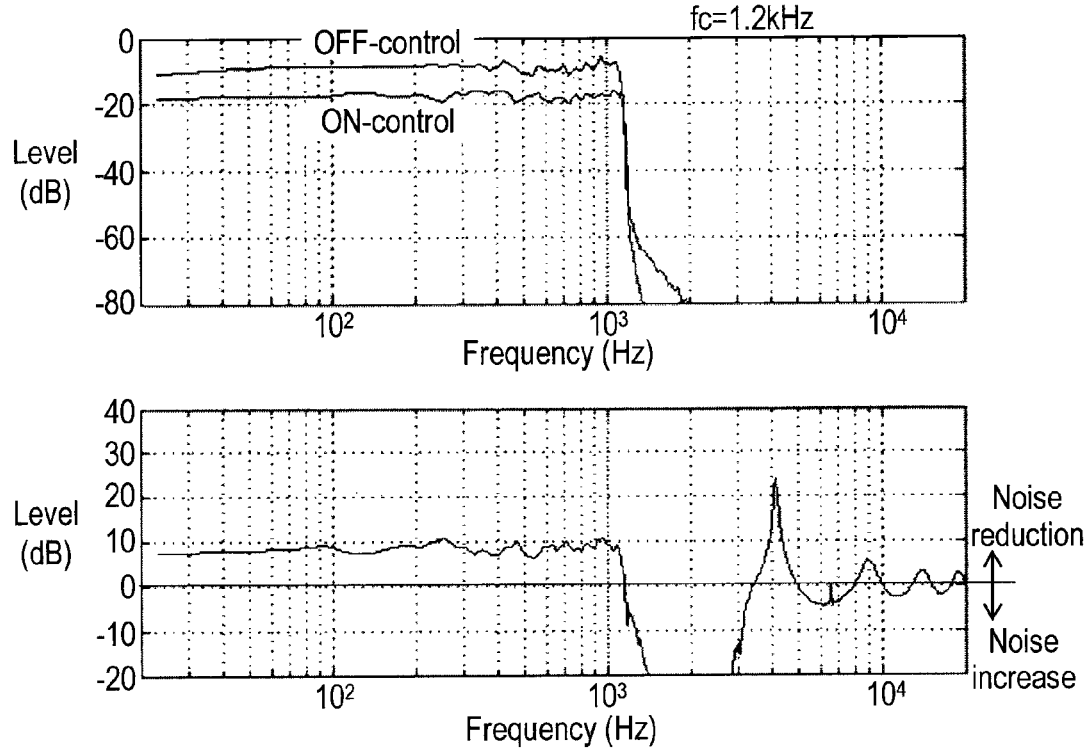
FIG. 34 shows a diagram illustrating a simulation result for the noise reduction effect (case where fc=1.2 kHz) in the noise reduction apparatus in the embodiment of the present invention.
Figure 35:
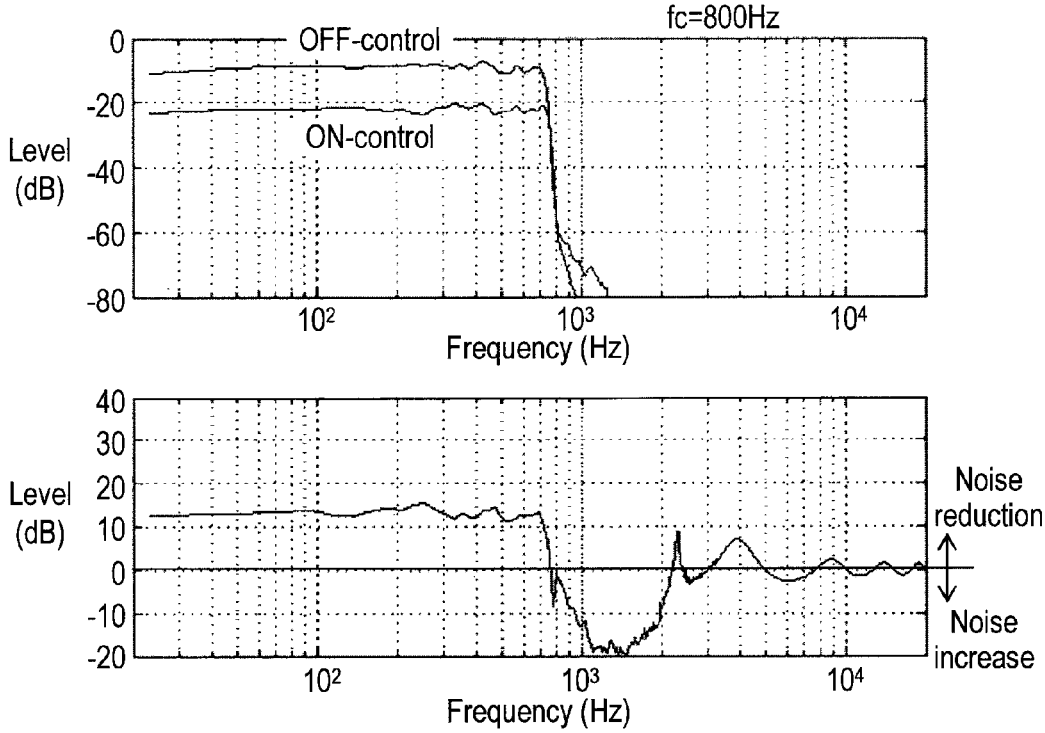
FIG. 35 shows a diagram illustrating a simulation result for the noise reduction effect (case where fc=800 Hz) in the noise reduction apparatus in the embodiment of the present invention.
Figure 36:
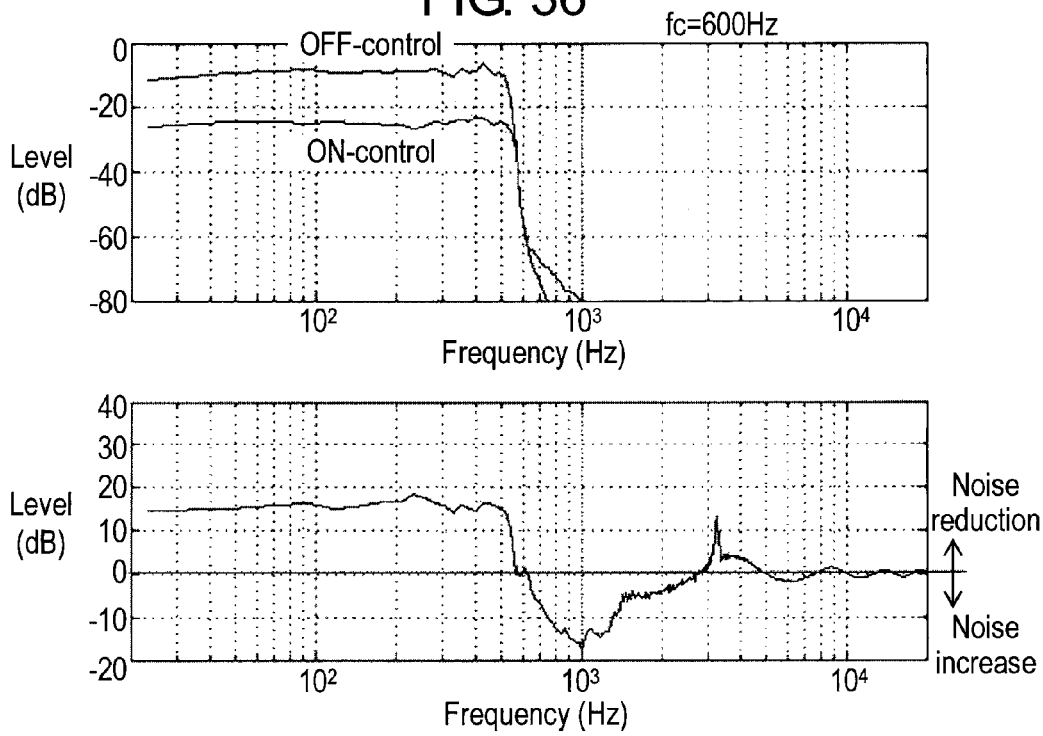
FIG. 36 shows a diagram illustrating a simulation result for the noise reduction effect (case where fc=600 Hz) in the noise reduction apparatus in the embodiment of the present invention.
Figure 37:
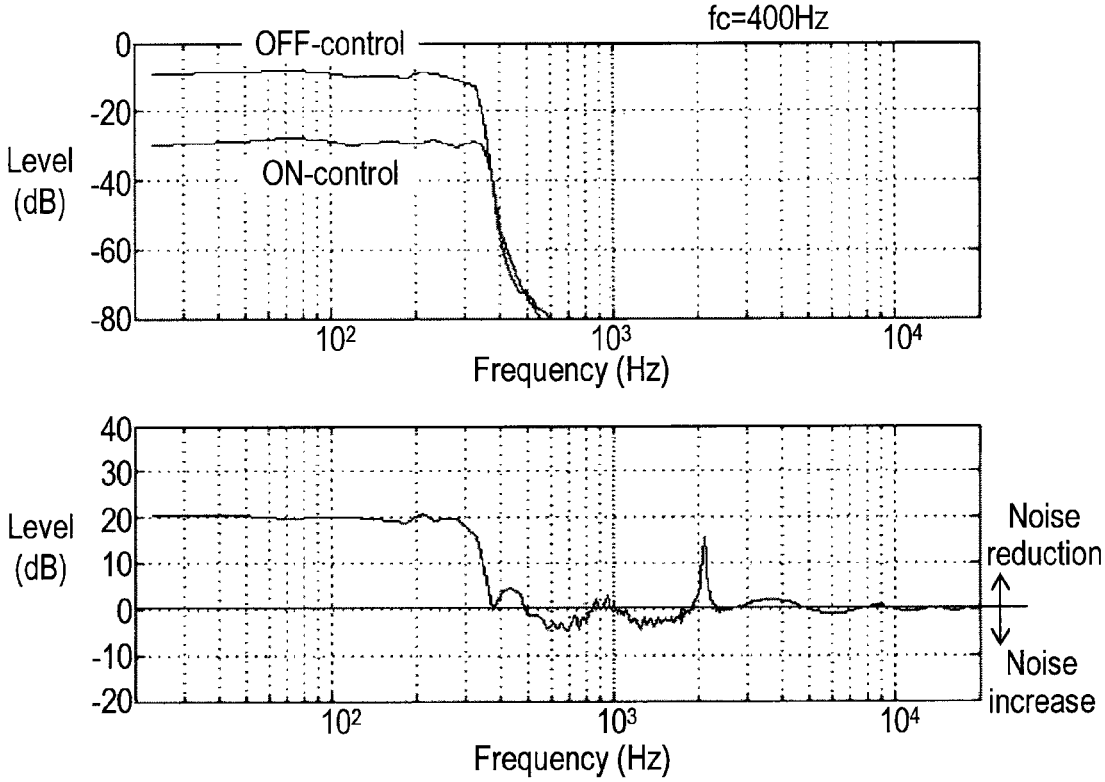
FIG. 37 shows a diagram illustrating a simulation result for the noise reduction effect (case where fc=400 Hz) in the noise reduction apparatus in the embodiment of the present invention.
Figure 38:
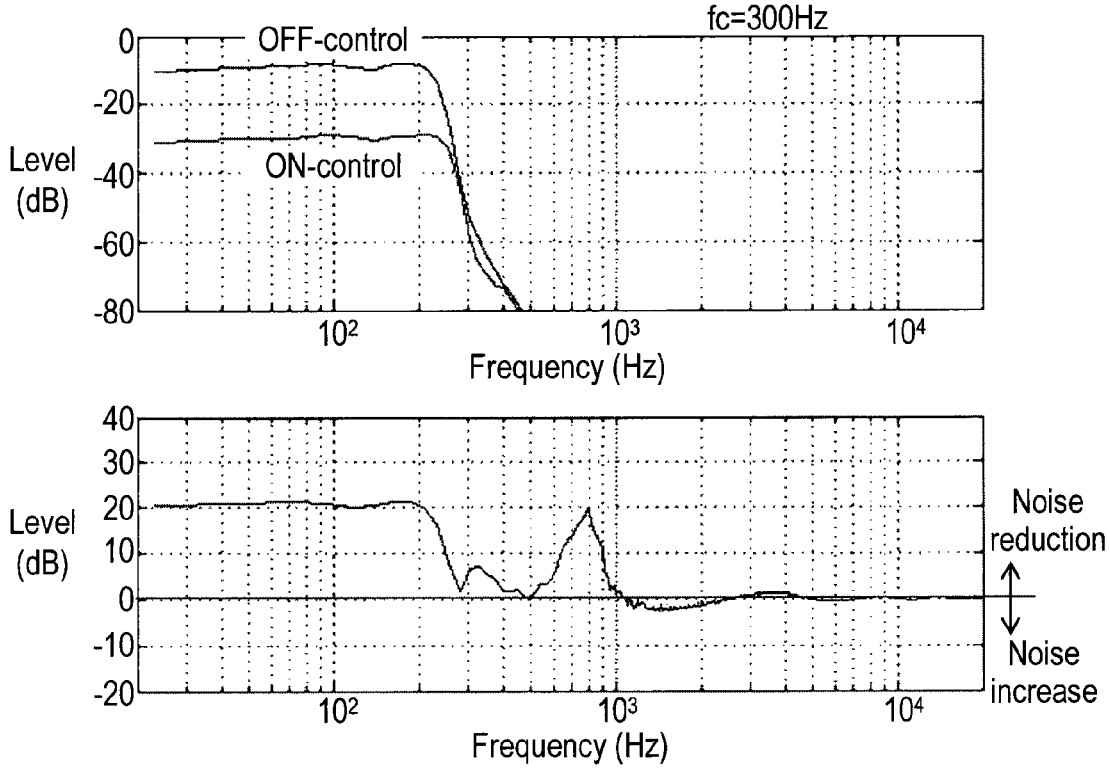
FIG. 38 shows a diagram illustrating a simulation result for the noise reduction effect (case where fc=300 Hz) in the noise reduction apparatus in the embodiment of the present invention.

Further, in setting of the delay of delay 703 in FIG. 10 as eleven samples, FIG. 31 shows an effect with fc=4.8 kHz; FIG. 32 shows an effect with fc=2.4 kHz; FIG. 33 shows an effect with fc=1.6 kHz; FIG. 34 shows an effect with fc=1.2 kHz; FIG. 35 shows an effect with fc=800 Hz; FIG. 36 shows an effect with fc=600 Hz; FIG. 37 shows an effect with fc=400 Hz; FIG. 38 shows an effect with fc=300 Hz; and FIG. 39 shows a result of summarizing those.

Figure 21:
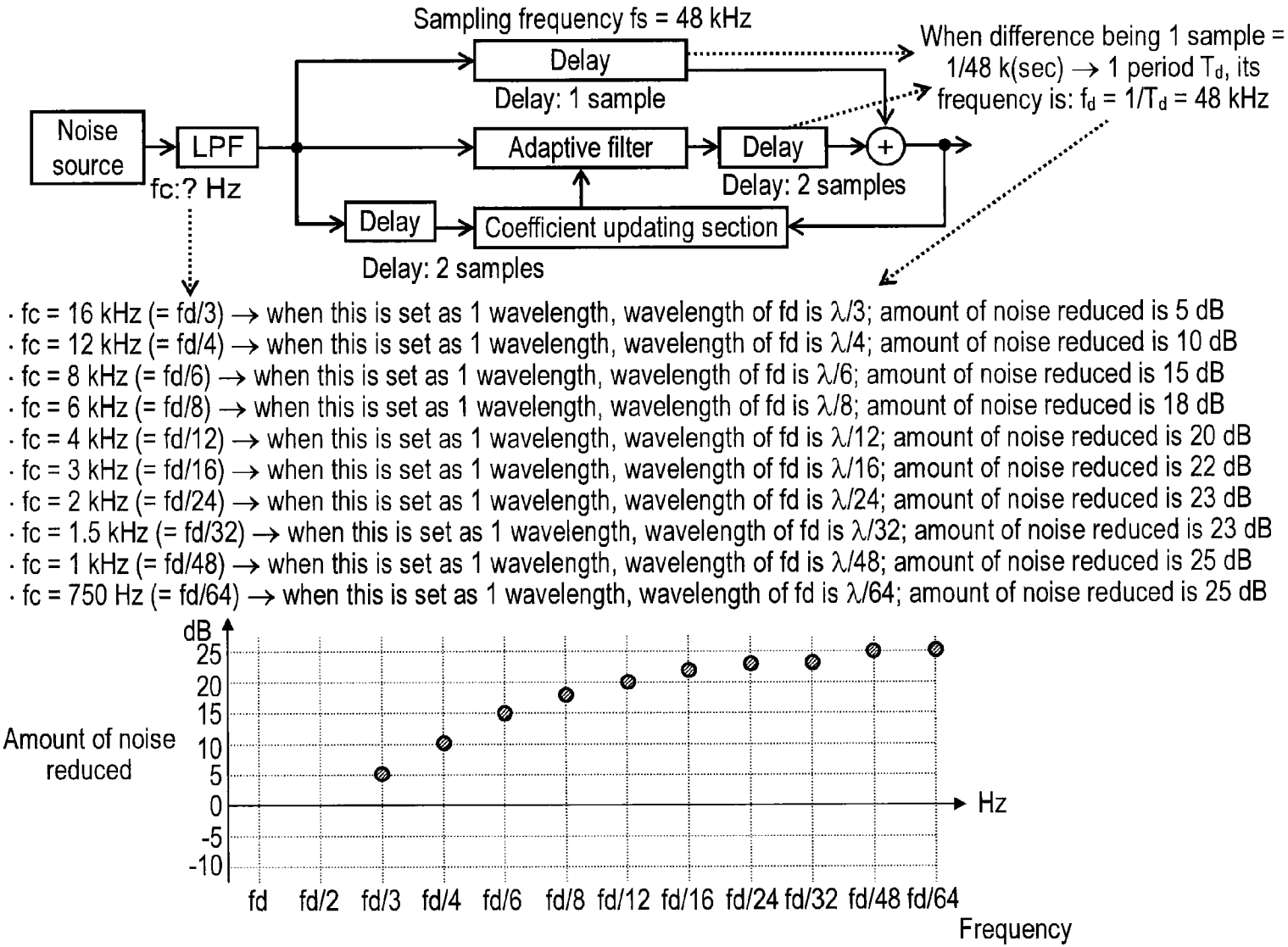
FIG. 21 shows a diagram illustrating a result of plotting, from FIGS. 11 to 20, amounts of noise reduced in the noise reduction apparatus in the embodiment of the present invention.
Figure 39:
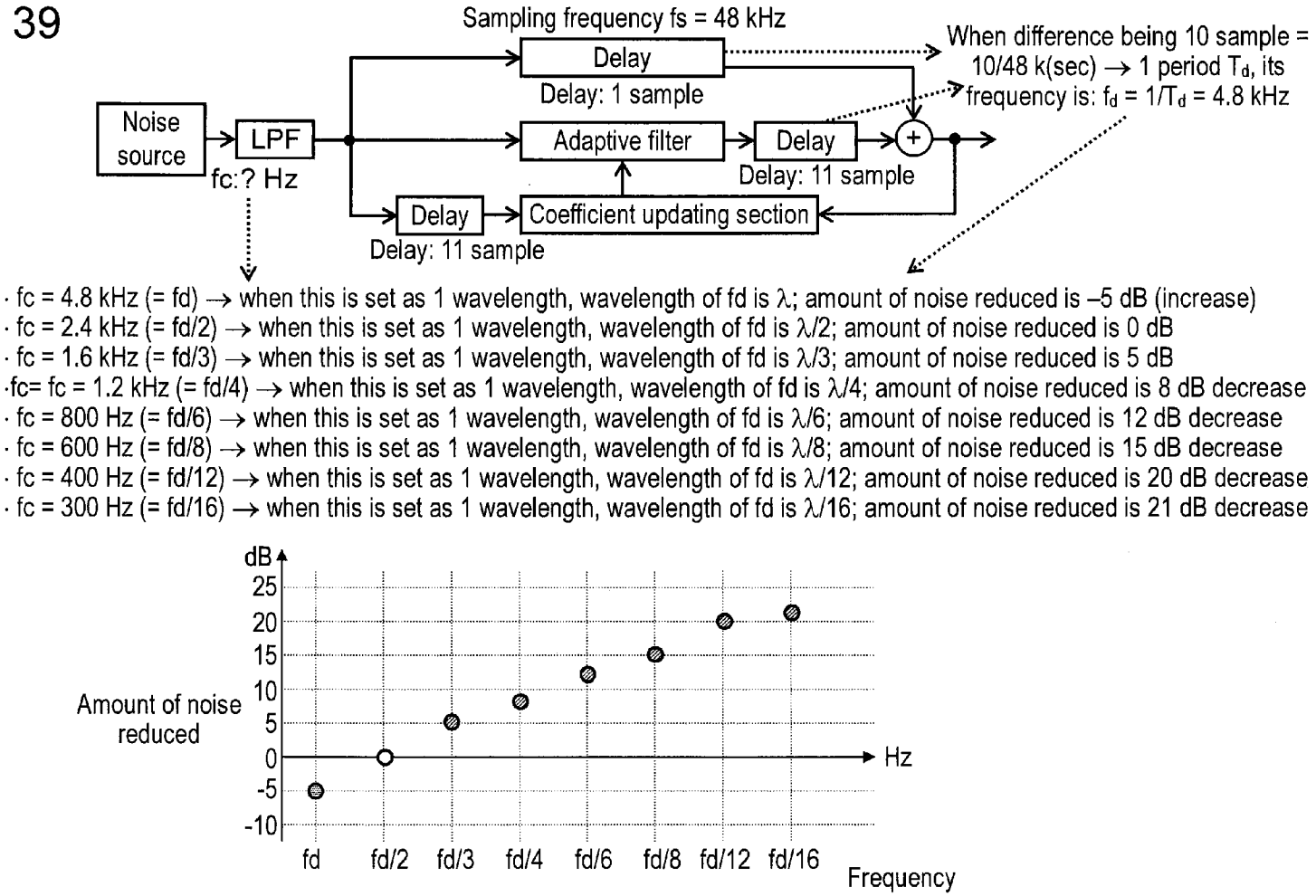
FIG. 39 shows a diagram illustrating a result of plotting, from FIGS. 31 to 38, amounts of noise reduced in the noise reduction apparatus in the embodiment of the present invention.

As seen in FIGS. 21, 30 and 39, when the difference sample between delay 761 of the noise transmittance system (corresponding to noise transmittance time Tp) and delay 703 of the control sound system (corresponding to control sound delay time Tq) in FIG. 10 is set as one period Td, the noise reduction effect is obtained with a wavelength shorter than a one-half wavelength. It is found that even on condition that the processing on adaptive filter 732 is not in time (the time causality limitation is not satisfied), the noise reduction effect can be obtained when the control band is limited to not larger than fd·½ with respect to frequency fd with the processing delay time set as one period Td. This limits an upper limited frequency of a control sound signal generated by noise controller 630 in FIG. 6 to fd·½.

According to the above simulation result, when control sound delay time, obtained by adding control delay time as a sum of respective delay time of microphone 620, noise controller 630, and speaker 640 to control sound transmittance time taken by a control sound to transmit from speaker 640 to control point X, is larger than noise transmittance time taken by noise to transmit from microphone 620 to control point X (the time causality limitation is not satisfied), the noise controller generates a control sound signal with one-half of frequency fd, one period of which is a difference between the control sound delay time and the noise transmittance time, as an upper limited frequency so that the noise control effect can be exerted.

Here, as a method for generating a control sound signal having an upper limited frequency in noise controller 630, an adaptive filter to input a signal with its band limited may be used as noise controller 630, for example as disclosed in Unexamined Japanese Patent Publication No. H4-359297. In addition, such a configuration may also be formed where the microphone is installed inside the shell as illustrated in FIGS. 4C 4D so that a signal with its band limited with respect to noise outside the shell is inputted into the microphone.

In other words, even in a case where the difference between the control sound delay time and the noise transmittance time is set as one period and a distance from microphone 620 to control point X is smaller only by a one-half wavelength than a distance obtained by adding a distance propagated by noise for the control delay time to a distance from speaker 640 to control point X, it is possible to exert noise control effect by the noise controller generating a control sound signal with fd/2 set as an upper limit, so as to bring microphone 620 closer to control point X.

Especially, as illustrated in FIGS. 4C 4D, in a case where microphones 420*a* to 420*f* are installed inside shell section 402*a* as the soundproof wall, since a high-frequency component of noise is blocked by shell section 402*a* and noise that enters inside is only a low-frequency component, the effect of the present invention can further be exerted. Particularly, in the case of FIG. 4D, since microphones 420*a* to 420*f* can be brought closer to the control point, a larger noise reduction effect can be exerted in the aircraft and the like where identifying a noise source is difficult.

It is to be noted that even in the case of no presence of a soundproof wall such as a shell, when a noise band is limited in a hermetically sealed space such as the aircraft, the effect of the present invention can be similarly exerted.

As described above, using the noise reduction apparatus of the present embodiment, it is possible to provide a noise reduction apparatus having adopted the feed forward control system capable of effectively exerting the noise reduction effect even in an environment where the positional relation among a microphone for noise detection, a speaker for control sound generation, and a control point cannot satisfy the time causality limitation in a cabin of an aircraft or the like.

It is to be noted that, although the description has been given taking the seat arrayed inside the aircraft by way of example as the control space in the present embodiment, this is not restrictive, and the noise reduction apparatus can be utilized also in the case of installing a noise reduction apparatus on a soundproof wall along an expressway, a railway track, or the like.

Further, although the four examples (FIGS. 4A to 4D) are described as the configurations of the noise reduction apparatus installed in the cabin of the aircraft in the present embodiment, a configuration in combination of these may also be formed. With such a configuration, a noise reduction apparatus having advantages of the respective examples in combination can be realized.

What is claimed is:

1. A noise reduction apparatus comprising:

a noise detecting microphone that detects noise emitted from a noise source; a control speaker that emits a control sound for canceling the noise at a control point in a control space based on a control sound signal; and a noise controller that generates the control sound signal, wherein when control sound delay time, obtained by adding delay time of the noise detecting microphone, delay time of the noise controller, delay time of the control speaker, and the control point, is larger than noise transmittance time taken by noise to transmit from the noise detecting microphone to the control point, the noise controller generates the control sound with one-half of a frequency; one period of which is a difference between the control sound delay time and the noise transmittance time, as an upper limited frequency.

2. The noise reduction apparatus according to claim 1, wherein the noise reduction apparatus is arranged on a seat, the seat including a shell section that surrounds the control point with a wall surface, the shell section being a soundproof wall, and a seat section arranged inside the shell section;

the control speaker is arranged on an inner side of the shell section; and the noise detecting microphone is arranged on a top of a wall surface of the shell section.

3. The noise reduction apparatus according to claim 1, wherein the noise reduction apparatus is arranged on a seat, the seat including a shell section that surrounds the control point with a wall surface, the shell section being a soundproof wall, and a seat section arranged inside the shell section;

the control speaker is arranged on an inner side of the shell section, and the noise detecting microphone is arranged on an outer wall surface of the shell section.

4. The noise reduction apparatus according to claim 1, wherein the noise reduction apparatus is arranged on a seat, the seat including a shell section that surrounds the control point with a wall surface, the shell section being a soundproof wall, and a seat section arranged inside the shell section;

the control speaker is arranged on an inner side of the shell section; and the noise detecting microphone is arranged on an inner wall surface of the shell section.

5. The noise reduction apparatus according to claim 1, wherein the noise reduction apparatus is arranged on a seat, the seat including a shell section that surrounds the control point with a wall surface, the shell section being a soundproof wall, and a seat section arranged inside the shell section;

the control speaker is arranged on an inner side of the shell section; and the noise detecting microphone is arranged inside the shell section.

6. The noise reduction apparatus according to any one of claims 2 to 5, wherein the control space is the seat arranged inside a passenger moving object.

7. The noise reduction apparatus according to claim 6, wherein the control point is a head position of a user seated on the seat section.

* * * * *

UNITED STATES PATENT AND TRADEMARK OFFICE

CERTIFICATE OF CORRECTION

PATENT NO. : 8,280,069 B2
APPLICATION NO. : 12/705743
DATED : October 2, 2012
INVENTOR(S) : Tsuyoshi Maeda et al.

It is certified that error appears in the above-identified patent and that said Letters Patent is hereby corrected as shown below:

In column 13, line 48, add --control delay time as a sum of respective-- after “adding”.

In column 13, line 49, add --and-- after “controller”.

In column 13, line 50, add --to control sound transmittance time taken by a control sound to transmit from the control speaker to-- before “the control point”.

Signed and Sealed this
Fifth Day of February, 2013

Teresa Stanek Rea
*Acting Director of the United States Patent and Trademark Office*